US009538307B2

(12) United States Patent
Araki

(10) Patent No.: US 9,538,307 B2
(45) Date of Patent: Jan. 3, 2017

(54) AUDIO SIGNAL REPRODUCTION DEVICE AND AUDIO SIGNAL REPRODUCTION METHOD

(71) Applicant: PANASONIC CORPORATION, Osaka (JP)

(72) Inventor: Junji Araki, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 482 days.

(21) Appl. No.: 14/013,939

(22) Filed: Aug. 29, 2013

(65) Prior Publication Data

US 2013/0343550 A1 Dec. 26, 2013

Related U.S. Application Data

(63) Continuation of application No. PCT/JP2012/002740, filed on Apr. 20, 2012.

(30) Foreign Application Priority Data

Apr. 22, 2011 (JP) ..... 2011-096505
May 16, 2011 (JP) ..... 2011-109808

(51) Int. Cl.
*H04R 5/02* (2006.01)
*H04S 5/00* (2006.01)
*H04S 3/00* (2006.01)

(52) U.S. Cl.
CPC . *H04S 5/00* (2013.01); *H04S 3/00* (2013.01); *H04S 2400/03* (2013.01); *H04S 2420/01* (2013.01)

(58) Field of Classification Search
CPC combination set(s) only.
See application file for complete search history.

(56) References Cited

U.S. PATENT DOCUMENTS 5,381,482 A 1/1995 Matsumoto et al.
5,870,484 A * 2/1999 Greenberger ..... H04R 5/02 381/17

(Continued)

FOREIGN PATENT DOCUMENTS

EP 1128706 A1 8/2001
JP 2004-187300 A 7/2004

(Continued)

OTHER PUBLICATIONS

International Search Report issued in PCT/JP2012/002740 with Date of mailing May 22, 2012.

*Primary Examiner* — Duc Nguyen
*Assistant Examiner* — Assad Mohammed
(74) *Attorney, Agent, or Firm* — McDermott Will & Emery LLP

(57) ABSTRACT

An audio signal reproduction device generates, from an obtained audio signal, first reproduction signals for the first speaker group, sounds from which are localized at first virtual sound positions, and second reproduction signals for the second speaker group, sounds from which are localized at second virtual sound positions substantially the same as the first virtual sound positions. The audio signal reproduction device generates the first reproduction signals and the second reproduction signals so that at least phases or sound pressure values of a first sound and a second sound are different at a listening position, the first sound being indicated by the first reproduction signals, and localized at a first position among the first virtual sound positions, the second sound being indicated by the second reproduction signals, localized at a substantially same position as the first position, and substantially the same as the first sound.

19 Claims, 19 Drawing Sheets

(56) References Cited

U.S. PATENT DOCUMENTS

| | | | | |
|---|---|---|---|---|
| 6,853,732 | B2 | 2/2005 | Scofield | |
| 7,050,596 | B2 | 5/2006 | Cheng | |
| 7,382,885 | B1 * | 6/2008 | Kim | H04S 3/02 381/1 |
| 7,676,047 | B2 | 3/2010 | Aylward et al. | |
| 8,139,797 | B2 | 3/2012 | Aylward et al. | |
| 8,199,940 | B2 | 6/2012 | Yokota | |
| 8,238,578 | B2 | 8/2012 | Aylward | |
| 2004/0105550 | A1 | 6/2004 | Aylward et al. | |
| 2004/0105559 | A1 | 6/2004 | Aylward et al. | |
| 2004/0196982 | A1 | 10/2004 | Aylward et al. | |
| 2005/0031128 | A1 | 2/2005 | Tomita et al. | |
| 2005/0226425 | A1 | 10/2005 | Polk | |
| 2006/0262937 | A1 * | 11/2006 | Kobayashi | H04S 3/002 381/27 |
| 2006/0269068 | A1 | 11/2006 | Yokota | |
| 2006/0269070 | A1 * | 11/2006 | Miura | H04R 5/04 381/17 |
| 2007/0183617 | A1 | 8/2007 | Yokota et al. | |
| 2007/0291949 | A1 | 12/2007 | Imaki | |
| 2008/0013745 | A1 * | 1/2008 | Chen | H03G 3/301 381/57 |
| 2008/0292121 | A1 * | 11/2008 | Yokota | H04R 5/04 381/301 |
| 2009/0136048 | A1 * | 5/2009 | Yoo | H04S 3/008 381/27 |
| 2010/0119081 | A1 | 5/2010 | Aylward | |
| 2010/0150382 | A1 * | 6/2010 | Ko | H04R 3/12 381/303 |
| 2012/0070021 | A1 * | 3/2012 | Yoo | H04S 3/002 381/306 |
| 2012/0224729 | A1 | 9/2012 | Aylward et al. | |

FOREIGN PATENT DOCUMENTS

| | | | |
|---|---|---|---|
| JP | 2006-345480 | A | 12/2006 |
| JP | 2008-270857 | A | 11/2008 |
| JP | 4348886 | B2 | 7/2009 |

* cited by examiner

FIG. 12

| | | Case 1 | Case 2 | Case 3 | Case 4 | Case 5 | Case 6 | Case 7 |
|---|---|---|---|---|---|---|---|---|
| Front speaker (51s) | FL | 1 | 1 | 2 | 2 | 1 | 1 | 1 |
| | FR | 1 | 1 | 2 | 2 | 1 | 1 | 1 |
| | C | 1 | 1 | 2 | 2 | 1 | 2 | 1 |
| | SL | 0 | 1 | 1 | 1 | 1 | 1 | 1 |
| | SR | 0 | 1 | 1 | 1 | 1 | 1 | 1 |
| Near-ear speaker (52s) | FL | 0 | 1 | 1 | 1 | 2 | 1 | 1 |
| | FR | 0 | 1 | 1 | 1 | 2 | 1 | 1 |
| | C | 0 | 1 | 1 | 1 | 2 | 2 | 1 |
| | SL | 1 | 2 | 2 | 1 | 2 | 1 | 1 |
| | SR | 1 | 2 | 2 | 1 | 2 | 1 | 1 |

AUDIO SIGNAL REPRODUCTION DEVICE AND AUDIO SIGNAL REPRODUCTION METHOD

CROSS REFERENCE TO RELATED APPLICATIONS

This is a continuation application of PCT International Application No. PCT/JP2012/002740 filed on Apr. 20, 2012, designating the United States of America, which is based on and claims priority of Japanese Patent Application No. 2011-109808 filed on May 16, 2011 and Japanese Patent Application No. 2011-096505 filed on Apr. 22, 2011. The entire disclosures of the above-identified applications, including the specifications, drawings and claims are incorporated herein by reference in their entirety.

FIELD

The present disclosure relates to audio signal processing technology for sound localization performed using a head-related transfer function (HRTF), and in particular to an audio signal reproduction device and an audio signal reproduction method having a function of achieving localization of virtual sounds at desired positions using speakers placed in front of a listening position (hereafter, referred to as front speakers) and speakers placed near the ears of a listener (hereafter, referred to as near-ear speakers).

BACKGROUND

An example of virtual sound localization technology is a method of achieving localization of virtual sounds in front of and behind a listener using an HRTF. With this method, virtual sounds are generated as follows.

First, a measurement speaker is placed at a desired position at which a virtual sound (hereinafter, also referred to as a virtual sound source) is localized, and an HRTF is measured from this measurement speaker to the entrance of the external ear canal of the listener. This measured HRTF is used as a target characteristic.

Next, an HRTF from a reproduction speaker used for virtual sound localization to a listening position is measured by reproducing a reproduction sound source. The HRTF measured in this way is used as a reproduction characteristic.

Here, the measurement speaker placed at a position where a virtual sound is to be localized is used only for measuring a target characteristic. Therefore, the measurement speaker is not used afterward when the listener reproduces a reproduction sound source. Only the reproduction speaker is used for localization of a virtual sound source by reproducing a reproduction sound source.

Then, an HRTF for virtual sound localization is calculated using the target characteristic and the reproduction characteristic. The calculated HRTF is used as a filter characteristic. The filter characteristic is convoluted into the reproduction sound source, thereby generating a reproduction sound source which the listener hears as if a sound were output from a virtual speaker.

When a virtual sound is generated in the above manner, as reproduction speakers used to reproduce reproduction sound sources, (1) front speakers placed in front of the listener are used as typified by a front virtual surround system, (2) near-ear speakers placed near the ears of the listener are used as typified by a headphone virtual surround system, and (3) front speakers placed in front of the listener and near-ear speakers placed near the ears of the listener are combined, and both types of the speakers are used.

Patent Literatures (PTLs) 1 and 2, for instance, disclose a system in which both a front speaker and a near-ear speaker are used.

For example, PTL 1 discloses a game machine body which has an expanded capability terminal. This expansion terminal has a sound output function. Further, the game machine body is connected to a television receiver which includes a speaker. This game machine body causes sound to be output from the television receiver, and also sound to be output from headphones connected to the expanded capability terminal.

Further, this game machine body has a function of giving, to a headphone reproduction signal, a time delay from when a sound is reproduced by a speaker to when the sound wave thereof reaches a listener. Specifically, the game machine body makes adjustment so that the listener hears the sound from the speaker and headphone reproduction signals from the headphones, simultaneously.

The above configuration allows a user to simultaneously listen to sound from the television receiver and sound from the headphones, thus achieving reproduction and creation of more realistic sound than before. Furthermore, a time delay is given to a headphone reproduction signal, thereby bringing a sound localization position close to or away from the listener.

Further, PTL 2 discloses a technique of improving the localization precision of an audio channel localized at a rear position in particular, by using both types of speaker, namely, front speakers and near-ear speakers.

CITATION LIST

Patent Literature

[PTL 1] Japanese Patent Publication No. 4348886
[PTL 2] Japanese Unexamined Patent Application Publication No. 2006-345480

SUMMARY

Technical Problem

However, the conventional techniques have problems that a position at which a virtual sound is localized is not definite.

In view of this, the present disclosure provides an audio signal reproduction device which can achieve localization of a virtual sound at a more exact position.

Solution to Problem

In order to solve the above conventional problems, an audio signal reproduction device according to an aspect of the present disclosure is an audio signal reproduction device which reproduces an audio signal using a first speaker group which includes plural speakers placed in vicinity of a listener and a second speaker group which includes plural speakers and is placed closer to the listener than the first speaker group is, the audio signal including position information indicating, for plural audio channels, positions of virtual sounds to be localized, the audio signal reproduction device including: an obtaining unit configured to obtain the audio signal; and a virtual sound field generation unit configured to generate, by performing signal processing on the audio signal, first reproduction signals for the first speaker group, sounds from which are localized at first virtual sound positions, and second reproduction signals for the second speaker group, sounds from which are localized at second virtual sound positions substantially the same as the first virtual sound positions, wherein the virtual sound field generation unit is configured to generate the first reproduction signals and the second reproduction signals so that at least phases or sound pressure values of a first sound and a second sound are different at a listening position, the first sound being indicated by the first reproduction signals, and localized at a first position among the first virtual sound positions, the second sound being indicated by the second reproduction signals, localized at a substantially same position as the first position, and substantially the same as the first sound.

According to this, the audio signal reproduction device can reduce a difference between sounds reproduced by the first speaker group and the second speaker group when the speaker groups generate the same sound. Thus, it is possible to achieve localization of a virtual sound at a more exact position.

Furthermore, the virtual sound field generation unit may be configured to adjust a time at which the first reproduction signals are output from the first speaker group and a time at which the second reproduction signals are output from the second speaker group so that times at which the first sound and the second sound having a substantially same feature are heard are different by a time in a predetermined range.

According to this configuration, an audio signal reproduction device 100 adjusts a time at which a sound is output from the first speaker group and a time at which a sound is output from the second speaker group, thereby performing control so that reproduced sounds reach a listener with an interval of a very short time in the predetermined range. Consequently, the listener will listen to two sounds to which the precedence effect is given. As a result, the listener hears the sounds as if a virtual sound field localized by using the sound which has reached later matches a virtual sound field localized by using the sound which has reached earlier. Furthermore, the listener perceives a sound which has reached earlier more strongly than a sound which has reached later. Thus, it is possible to reduce an odd feeling when the listener hears sound due to separation, imbalance, or loss of sharpness which is caused in the virtual sound fields generated by the front speakers and the near-ear speakers, and furthermore an advantage achieved when a sound is output from a front speaker and an advantage achieved when a sound is output from a near-ear speaker can be utilized.

Furthermore, the virtual sound field generation unit may be configured to generate the first reproduction signals and the second reproduction signals so that the first sound arrives at the listening position earlier than the second sound by the time in the predetermined range.

According to this configuration, the sound reproduced by the first speaker group contributes more to the localization of a virtual sound field. As a result, the audio signal reproduction device 100 can achieve localization with a better sense of distance.

Furthermore, the virtual sound field generation unit may be configured to generate the first reproduction signals and the second reproduction signals so that the second sound arrives at the listening position earlier than the first sound by the time in the predetermined range.

According to this configuration, the sound reproduced by the second speaker group contributes more to the localization of a virtual sound field. As a result, the audio signal reproduction device 100 can achieve localization with a better sense of direction.

Furthermore, when the first position is behind the listener, the virtual sound field generation unit may be configured to generate the first reproduction signals and the second reproduction signals so that the second sound arrives at the listening position earlier than the first sound.

This configuration allows the second speaker group to output earlier sounds whose acoustic images are localized behind a listener, and which have a substantially same feature and are included in the first reproduction signals and the second reproduction signals. In this manner, regarding sounds whose acoustic images are localized behind a listener, the listener strongly perceives sounds output from the second speaker group. As a result, although the listener hears sounds from the first speaker group and the second speaker group, the listener can recognize the direction of a localization position of a sound from behind more clearly.

Furthermore, when the first position is in front of the listener, the virtual sound field generation unit may be configured to generate the first reproduction signals and the second reproduction signals so that the first sound arrives at the listening position earlier than the second sound.

This configuration allows the first speaker group to output earlier sounds whose acoustic images are localized in front of a listener, and which have a substantially same feature and are included in the first reproduction signals and the second reproduction signals. In this manner, regarding sounds whose acoustic images are localized in front of a listener, the listener strongly perceives sounds output from the first speaker group. As a result, although the listener hears sounds from the first speaker group and the second speaker group, the listener can recognize the distance to a sound localization position of a front sound more clearly.

Specifically, the predetermined range may be greater than 0 milliseconds and less than 20 milliseconds.

Furthermore, the virtual sound field generation unit may further include a sound pressure value adjustment unit configured to adjust the sound pressure values by multiplying each of the plural audio channels by a corresponding gain.

This configuration allows the virtual sound field generation unit to change a gain for each audio channel signal corresponding to a virtual sound source to be localized, and generate a virtual sound field. Specifically, for each virtual sound source, a sound pressure value of a sound reproduced by a virtual sound source can be changed, and the gain balance of the whole virtual sound field can be adjusted. As a result, it is possible to reduce the imbalance and separation of sound fields caused by virtual sounds generated by the first speaker group and the second speaker group.

Furthermore, the virtual sound field generation unit may be configured to generate the first reproduction signals so that among the sounds localized at the first virtual sound positions, a sound pressure value of a sound localized in front of the listener is greater than a sound pressure value of a sound localized behind the listener.

Furthermore, the virtual sound field generation unit may be configured to generate the second reproduction signals so that among the sounds localized at the second virtual sound positions, a sound pressure value of a sound localized behind the listener is greater than a sound pressure value of a sound localized in front of the listener.

It should be noted that the present disclosure can be achieved not only as an audio signal reproduction device, but also as an audio signal reproduction method in which processing units included in the audio signal reproduction device are achieved as steps, as a program which causes a computer to execute these steps, a computer-readable recording medium such as a CD-ROM having stored therein the program, or as information, data, or a signal indicating the program. In addition, the program, the information, the data, and the signal may be delivered via a communication network such as the Internet.

Furthermore, the present disclosure can be achieved as a semiconductor integrated circuit (LSI) which achieves some or all of the functions of such an audio signal reproduction device, or as an audio signal reproduction system in which such an audio signal reproduction device is included.

Advantageous Effects

As described above, an audio signal reproduction device can be provided which achieves localization of a virtual sound at a more exact position.

BRIEF DESCRIPTION OF DRAWINGS

These and other advantages and features will become apparent from the following description thereof taken in conjunction with the accompanying Drawings, by way of non-limiting examples of embodiments disclosed herein.

FIG. 12 illustrates gains of signal values of audio channel signals reproduced by speakers, in the audio signal reproduction device according to Embodiment 2 and a variation thereof.

DESCRIPTION OF EMBODIMENTS (Underlying Knowledge Forming Basis of the Present Disclosure)

The inventors of the preset application have found that the virtual sound localization technique described in the "Background" section has the following problems.

In general, it is known that a front virtual surround system in which a front speaker is used achieves high localization precision of an audio channel (i.e., virtual sound) located in front of a listener. However, this surround system achieves low localization precision of an audio channel localized behind a listener. In contrast, it is known that a virtual surround system in which a near-ear speaker is used achieves high localization precision of the direction of an audio channel. The virtual surround system, however, cannot appropriately reproduce a sense of distance of an audio channel localized particularly in front of a listener. Specifically, such an audio channel tends to be localized at a position closer to a listener than to a target position.

In the case of PTL 1, a listener simultaneously hears a sound from a speaker and a headphone reproduced signal from headphones. Thus, it is difficult to utilize the advantage of the front speakers and the advantage of the near-ear speakers described above. This results in an inaccurate localization position of a virtual sound.

Further, the front speakers and the near-ear speakers achieve localization of virtual sounds at the same position, which causes the imbalance of the sound fields formed by the virtual sounds, resulting in an unnatural sound field. Furthermore, if the output sound pressure level of one of a front speaker and a near-ear speaker is extremely high, a virtual sound from that one speaker is dominant, which separates the sound fields. This also results in an inaccurate localization position of a virtual sound.

The present disclosure provides an audio signal reproduction device which can achieve localization of a virtual sound at a more exact position by solving the above problems.

The following describes exemplary embodiments with reference to the drawings. Each of the exemplary embodiments described below shows a specific example. The numerical values, shapes, constituent elements, the arrangement and connection of the constituent elements, steps, the processing order of the steps and the like described in the following embodiments are mere examples, and thus do not limit the scope of the appended Claims and their equivalents. Therefore, among the constituent elements in the following exemplary embodiments, constituent elements not recited in any of the independent claims defining the most generic part of the inventive concept are described as arbitrary constituent elements.

Embodiment 1

Figure 1:
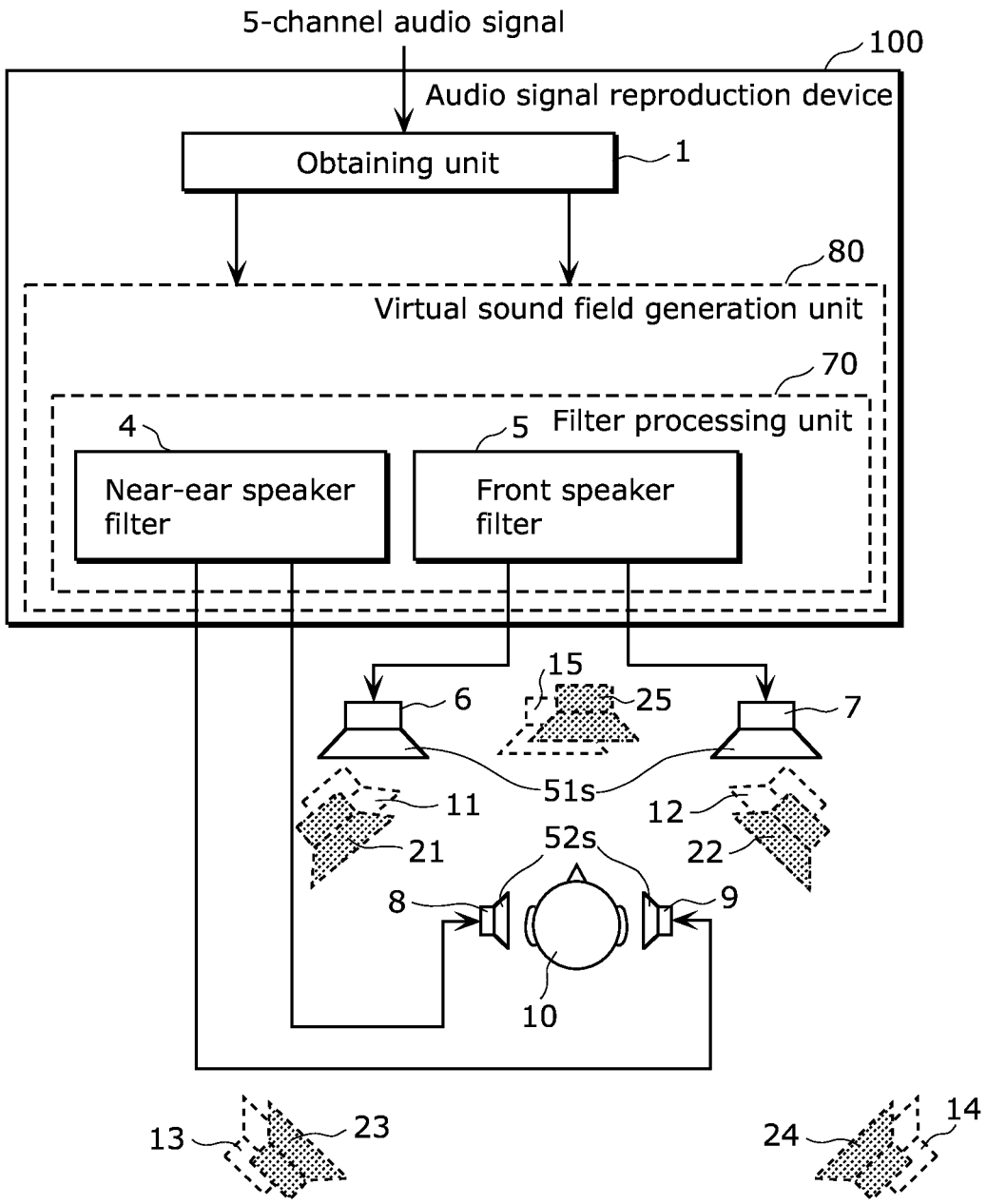
FIG. 1 is a block diagram illustrating a configuration of an audio signal reproduction device according to Embodiments 1 and 2.

FIG. 1 illustrates functional blocks of an audio signal reproduction device 100 according to the present embodiment.

The audio signal reproduction device 100 reproduces an audio signal using a first speaker group 51*s* which includes plural speakers placed in the vicinity of a listener 10 and a second speaker group 52*s* which includes plural speakers and is placed closer to the listener than the first speaker group 51*s* is, the audio signal including position information indicating, for plural audio channels, virtual sound positions to be localized.

As illustrated in FIG. 1, the audio signal reproduction device 100 includes an obtaining unit 1 and a virtual sound field generation unit 80.

The obtaining unit 1 obtains an audio signal from a sound source, and divides the audio signal into two audio signals.

The virtual sound field generation unit 80 generates, by performing signal processing on the audio signal, first reproduction signals for the first speaker group 51*s*, sounds from which are localized at first virtual sound positions, and second reproduction signals for the second speaker group 52*s*, sounds from which are localized at second virtual sound positions substantially the same as the first virtual sound positions. Here, the virtual sound field generation unit 80 generates the first reproduction signals and the second reproduction signals so that at least phases or sound pressure values of a first sound and a second sound are different at a listening position, the first sound being indicated by the first reproduction signals, and localized at a first position among the first virtual sound positions, the second sound being indicated by the second reproduction signals, localized at a substantially same position as the first position, and substantially the same as the first sound.

The following describes, as Embodiment 1, a specific example in more detail in which the virtual sound field generation unit 80 generates the first reproduction signals and the second reproduction signals so that phases of the first sound and a second sound are different at the listening position.

Figure 2:
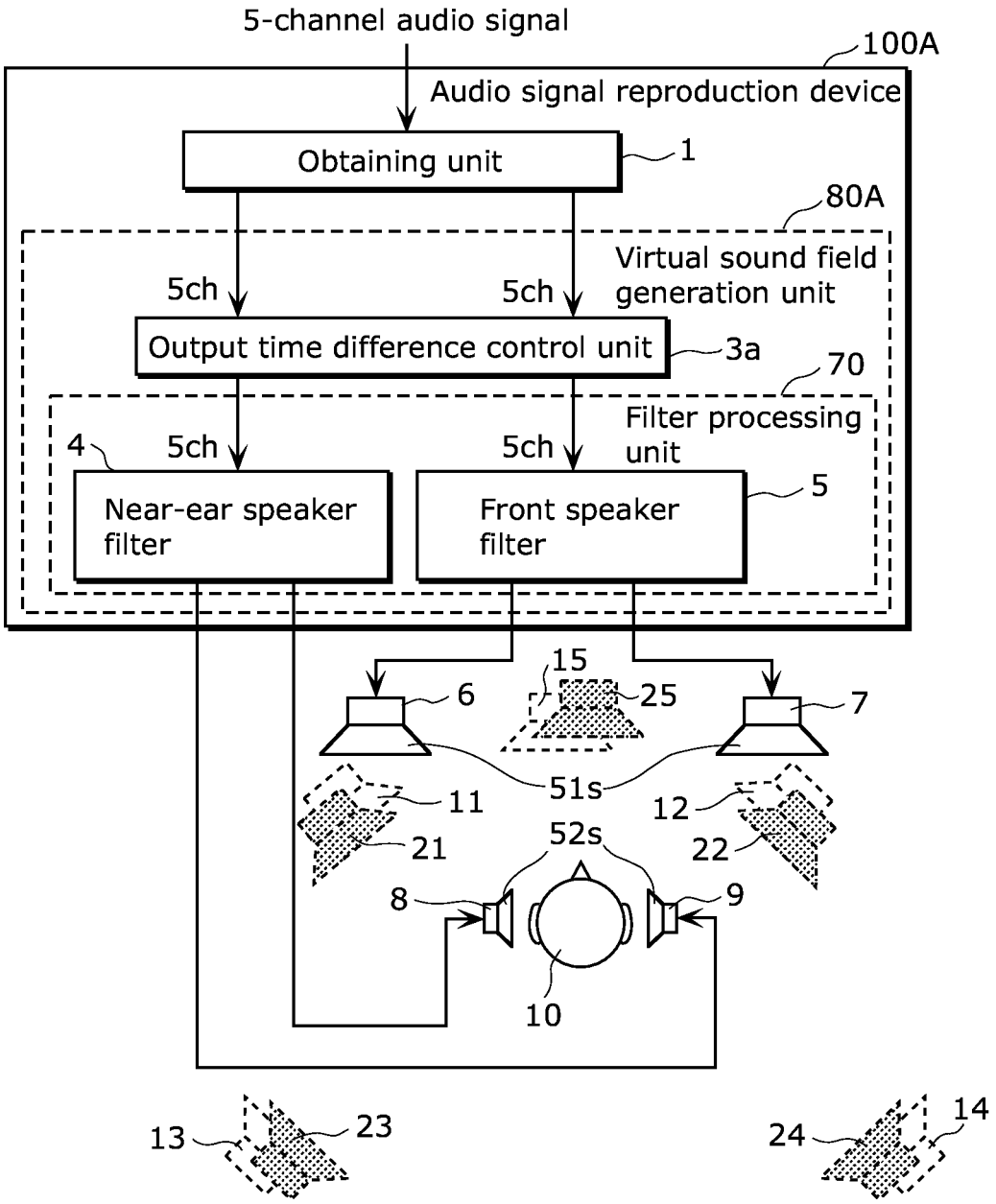
FIG. 2 is a block diagram illustrating a configuration of the audio signal reproduction device according to Embodiment 1.

FIG. 2 is a block diagram illustrating a configuration of the audio signal reproduction device 100A according to the present embodiment.

The audio signal reproduction device 100A according to the present embodiment outputs audio signals on which sound field generation processing has been performed to the first speaker group 51*s* which includes plural speakers placed in the vicinity of a listener, and the second speaker group 52*s* which includes plural speakers placed closer to the listener than the first speaker group 51*s* is.

As illustrated in FIG. 2, the audio signal reproduction device 100A includes the obtaining unit 1 and the virtual sound field generation unit 80A.

The obtaining unit 1 obtains an audio signal which includes plural audio channel signals. Although a description is given using an example in which a 5-channel audio signal (i.e., an audio signal which includes 5-audio channel signals) in the present embodiment, the number of audio channel signals is not limited to this. For example, an audio signal which includes given audio channel signals, such as a 2-channel, 4-channel, or 7-channel audio signal may be input.

Further, the obtaining unit 1 divides the obtained audio signal, and generates first audio signals to be reproduced as first reproduction sounds by the first speaker group 51*s*, and second audio signals to be reproduced as second reproduction sounds by the second speaker group 52*s*.

The virtual sound field generation unit 80A generates, by performing signal processing on the first audio signals and the second audio signals, first reproduction signals for the first speaker group, sounds from which are localized at first virtual sound positions, and second reproduction signals for the second speaker group, sounds from which are localized at second virtual sound positions. Here, the virtual sound field generation unit 80A generates the first reproduction signals and the second reproduction signals so that phases of a first sound and a second sound are different at a listening position, the first sound being indicated by the first reproduction signals, and localized at a first position among the first virtual sound positions, the second sound being indicated by the second reproduction signals, localized at a substantially same position as the first position, and substantially the same as the first sound. In the following, the first audio signals on which signal processing has been performed by the virtual sound field generation unit 80A are also referred to as first reproduction signals. Further, the second audio signals on which signal processing has been performed by the virtual sound field generation unit 80A are also referred to as second reproduction signals.

It should be noted that two sounds having a substantially same feature may include two sounds having the same feature. Further, a "feature" means a frequency of a sound, the value of amplitude of a sound, or the like, and two sounds having a substantially same feature are also referred to as the "same sound" in the following.

Specifically, the virtual sound field generation unit 80A adjusts a time at which the first reproduction signals are output from the first speaker group 51*s* and a time at which the second reproduction signals are output from the second speaker group 52*s* so that times at which the first sound and the second sound having a substantially same feature are heard are different by a time in a predetermined range.

For example, the virtual sound field generation unit 80A may generate the first reproduction signals and the second reproduction signals so that the first sound arrives at the listening position of the listener 10 earlier than the second sound by the time in the predetermined range.

Further, the virtual sound field generation unit 80A may generate the first reproduction signals and the second reproduction signals so that the second sound arrives at the listening position of the listener 10 earlier than the first sound by the time in the predetermined range.

More specifically, the virtual sound field generation unit 80A has an output time difference control unit 3*a* and a filter processing unit 70.

The output time difference control unit 3*a* controls the difference between times at which the first reproduction signals and the second reproduction signals are output so that the first sound and the second sound reach the listener 10 at times that differ by a predetermined time.

It should be noted that the virtual sound field generation unit 80A may perform sound field generation processing so that the first sound reaches the listener 10 earlier than the second sound, or conversely may perform sound field generation processing so that the second sound reaches the listener 10 earlier than the first sound. In other words, the output time difference control unit 3*a* may control the difference between the output times so that the first sound reaches the listener 10 earlier than the second sound, or conversely may control the difference between the output times so that the second sound reaches the listener 10 earlier than the first sound.

The filter processing unit 70 performs filter processing on the first audio signals and the second audio signals so that a third speaker group localized by using the first reproduction sounds and a fourth speaker group localized by using the second reproduction sounds are localized at the same predetermined position.

For example, the filter processing unit 70 according to the present embodiment converts 5-channel first audio signals into 2-channel signals, and outputs the resultant signals to the first speaker group 51*s*. The listener 10 who hears the first reproduction sounds reproduced by the first speaker group 51*s* localizes speakers which are included in the third speaker group at positions corresponding to five channels and included in the audio signals. Further, the filter processing unit 70 converts 5-channel second audio signals into 2-channel signals, and outputs the resultant signals to the second speaker group 52*s*. The listener 10 who hears the second reproduction sounds reproduced by the second speaker group 52*s* localizes speakers which are included in the fourth speaker group at positions corresponding to the five channels included in the audio signals. The specific processing to be performed by the filter processing unit 70 is determined based on an HRTF according to the related art described above, and thus details thereof are omitted.

More specifically, the filter processing unit 70 includes a near-ear speaker filter 4 and a front speaker filter 5.

The front speaker filter 5 performs filter processing on the first audio signals so that the third speaker group (virtual sound sources 11 to 15 described below) is localized at predetermined positions by using the first reproduction sounds.

The near-ear speaker filter 4 performs filter processing on the second audio signals so that the fourth speaker group (virtual sound sources 21 to 25 which are described below) is localized at predetermined positions by using the second reproduction sounds.

The following is a further detailed description of the audio signal reproduction device 100A having the above configuration.

The first speaker group 51*s* according to the present embodiment includes a front left (L) speaker 6 and a front right (R) speaker 7. The second speaker group 52*s* includes a near-ear L speaker 8 and a near-ear R speaker 9.

The audio signal reproduction device 100A reproduces a front L channel signal (hereinafter, referred to as "FL signal") included in a multichannel audio signal which is an input signal, using at least one of a pair formed by the front L speaker 6 and the front R speaker 7 and a pair formed by the near-ear L speaker 8 and the near-ear R speaker 9. Accordingly, the audio signal reproduction device 100A achieves localization of a virtual sound source for reproducing the FL signal, as a virtual front L channel speaker (hereinafter, referred to as "virtual FL speaker"). In the present embodiment, a virtual FL speaker 11 is localized by using the first reproduction sounds reproduced by both the front L speaker 6 and the front R speaker 7, and a virtual FL speaker 21 is localized by using the second reproduction sounds reproduced by both the near-ear L speaker 8 and the near-ear R speaker 9.

Further, the audio signal reproduction device 100A reproduces a front R channel signal (hereinafter, referred to as "FR signal") included in a multichannel audio signal which is an input signal, using at least one of a pair formed by the front L speaker 6 and the front R speaker 7 and a pair formed by the near-ear L speaker 8 and the near-ear R speaker 9. Thus, the audio signal reproduction device 100A achieves localization of a virtual sound source for reproducing the FR signal, as a virtual front R channel speaker (virtual FR speaker). In the present embodiment, a virtual FR speaker 12 is localized by using the first reproduction sounds reproduced by both the front L speaker 6 and the front R speaker 7, and a virtual FR speaker 22 is localized by using the second reproduction sounds reproduced by both the near-ear L speaker 8 and the near-ear R speaker 9.

Similarly, the audio signal reproduction device 100A reproduces a surround L channel signal (hereinafter, referred to as "SL signal") included in a multichannel audio signal which is an input signal, using at least one of a pair formed by the front L speaker 6 and the front R speaker 7 and a pair formed by the near-ear L speaker 8 and the near-ear R speaker 9. Accordingly, the audio signal reproduction device 100A achieves localization of a virtual sound source for reproducing the SL signal, as a virtual surround L channel speaker (virtual SL speaker). In the present embodiment, a virtual SL speaker 13 is localized by using the first reproduction sounds reproduced by both the front L speaker 6 and the front R speaker 7, and a virtual SL speaker 23 is localized by using the second reproduction sounds reproduced by both the near-ear L speaker 8 and the near-ear R speaker 9.

Further, the audio signal reproduction device 100A reproduces a surround R channel signal (hereinafter, referred to as "SR signal") included in a multichannel audio signal which is an input signal, using at least one of a pair formed by the front L speaker 6 and the front R speaker 7 and a pair formed by the near-ear L speaker 8 and the near-ear R speaker 9. Accordingly, the audio signal reproduction device 100A achieves localization of a virtual sound source for reproducing the SR signal as a virtual surround R channel speaker (virtual SR speaker). In the present embodiment, a virtual SR speaker 14 is localized by using the first reproduction sounds reproduced by both the front L speaker 6 and the front R speaker 7, and a virtual SR speaker 24 is localized by using the second reproduction sounds reproduced by both the near-ear L speaker 8 and the near-ear R speaker 9.

Further, the audio signal reproduction device 100A reproduces a center channel signal (hereinafter, referred to as "C signal") included in a multichannel audio signal which is an input signal using at least one of a pair formed by the front L speaker 6 and the front R speaker 7 and a pair formed by the near-ear L speaker 8 and the near-ear R speaker 9. Accordingly, the audio signal reproduction device 100A achieves localization of a virtual sound source for reproducing the C signal as a virtual center channel speaker (virtual C speaker). In the present embodiment, a virtual C speaker 15 is localized by using the first reproduction sounds reproduced by both the front L speaker 6 and the front R speaker 7, and a virtual C speaker 25 is localized by using the second reproduction sounds reproduced by both the near-ear L speaker 8 and the near-ear R speaker 9.

As illustrated in FIG. 2, an input signal which includes plural audio channel signals (FR signal, SR signal, FL signal, SL signal, and C signal) is input from the obtaining unit 1. Here, the audio channel signals correspond to the virtual speakers.

The output time difference control unit 3*a* controls the phase difference between front speaker signals and near-ear speaker signals, and controls the times at which the signals are output from the front speakers and the near-ear speakers provided downstream in the processing.

The near-ear speaker filter 4 performs filter processing, based on a near-ear speaker filter coefficient, on 5-channel near-ear speaker signals (i.e., second audio signals) output from the output time difference control unit 3*a*. The near-ear speaker filter 4 thereby generates 2-channel virtual sound field generation signals, and outputs audio channel signals to the near-ear L speaker 8 and the near-ear R speaker 9.

Processing by the near-ear speaker filter 4 based on the near-ear speaker filter coefficient is as follows if, for example, an SL signal and an SR signal are included in near-ear speaker signals. Specifically, virtual sound field generation signals generated by the near-ear speaker filter 4 processing the SL signal and the SR signal are to be reproduced by the near-ear L speaker 8 and the near-ear R speaker 9. Processing based on the near-ear speaker filter coefficient is processing for giving, to each of the SL signal and the SR signal, a feature which allows the listener 10 to perceive, at this time, as if the SL signal were reproduced by the virtual SL speaker 23 which is a virtual sound source localized at a position corresponding to the SL signal, and the SR signal were reproduced by the virtual SR speaker 24 which is a virtual sound source localized at a position corresponding to the SR signal.

The front speaker filter 5 performs filter processing, based on a front speaker filter coefficient, on 5-channel front speaker signals (i.e., the first audio signals) output from the output time difference control unit 3*a*. The front speaker filter 5 thereby generates 2-channel virtual sound field generation signals, and outputs the generated signals to the front L speaker 6 and the front R speaker 7.

Processing performed by the front speaker filter 5 based on the front speaker filter coefficient is as follows if, for example, an SL signal and an SR signal are included in the front speaker signals. Specifically, the virtual sound field generation signals generated by the front speaker filter 5 processing the SL signal and the SR signal are to be reproduced by the front L speaker 6 and the front R speaker 7. Processing based on the front speaker filter coefficient is processing for giving, to each of the SL signal and the SR signal, a feature which allows the listener 10 to perceive at this time as if the SL signal were reproduced by the virtual SL speaker 13 which is a virtual sound source localized at a position corresponding to the SL signal, and the SR signal were reproduced by the virtual SR speaker which is a virtual sound source localized at a position corresponding to the SR signal.

By listening to sounds reproduced by the first speaker group which includes the front L speaker 6 and the front R speaker 7 and the second speaker group which includes the near-ear L speaker 8 and the near-ear R speaker 9 via the audio signal reproduction device 100A having such a configuration, the listener 10 hears reproduced sounds from the positions of the virtual FL speakers 11 and 21, the virtual FR speakers 12 and 22, the virtual SL speakers 13 and 23, the virtual SR speakers 14 and 24, and the virtual C speakers 15 and 25, which are virtual sound sources that do not actually exist.

Here, as described above, when virtual sound sources are localized by using the first reproduction sounds reproduced by the first speaker group and the second reproduction sounds reproduced by the second speaker group, if the same sound for localizing the same virtual sound source is reproduced by each speaker group so as to reach the listener 10 simultaneously, the listener has an odd feeling when hearing sound.

The present disclosure provides the audio signal reproduction device for solving this problem, and thus the following describes in more detail this problem and a solution therefor.

Figure 3:
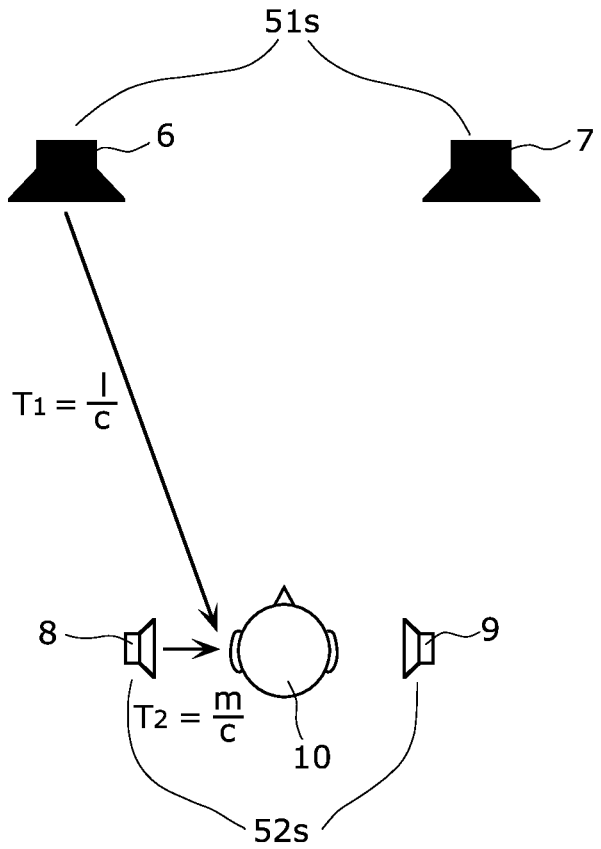
FIG. 3 illustrates an example of a positional relationship between a listener and speaker groups.

FIG. 3 illustrates an example of a positional relationship between a listener and speakers included in the first speaker group 51*s* and the second speaker group 52*s*. Here, the distance between the front L speaker 6 and the listener 10 is l [m], and the distance between the near-ear L speaker 8 and the listener 10 is m [m] (l>>m). Further, the speed of sound is c [m/s]. At this time, a time $T_1$ for the first sound included in the first reproduction sound reproduced by the front L speaker 6 to reach the listener 10 is $T_1=l/c$ [s], and a time $T_2$ for the second sound included in the second reproduction sound reproduced by the near-ear L speaker 8 to reach the listener 10 is $T_2=m/c$ [s].

Thus, if a time at which the first sound is reproduced by the front L speaker 6 and a time at which the second sound is reproduced by the near-ear L speaker 8 are the same, the second sound reaches the listener 10 earlier than the first sound by $T_1-T_2$ [s]. For example, if l=5 [m], m=3 [cm], and c=346 [m/s], $T_1-T_2$ is about 15 [ms]. Specifically, if the first sound and the second sound are the same, the listener 10 will hear the same sound after 15 [ms] interval. The listener 10 hears the sounds as an unnatural echo.

Therefore, conventionally, it is general to control reproduction times, to cause the same sound to reach the listener 10 simultaneously by the near-ear L speaker 8 reproducing the same sound later than the front L speaker 6 by $T_1-T_2$ [s]. Specifically, the value of $T_1-T_2$ is previously calculated from the positional relationships (the above-mentioned l, m) between the listener 10 and the first speaker group 51*s* and between the listener 10 the second speaker group 52*s*, and the second speaker group 52*s* reproduces the same sound later than the first speaker group 51*s* by $T_1-T_2$ [s].

However, as described above, even if the sounds reproduced by the first speaker group 51*s* on which filter processing has been performed based on the front speaker filter coefficient and the sounds reproduced by the second speaker group 52*s* on which the filter processing has been performed based on the near-ear speaker filter coefficient reach the listener 10 simultaneously, the listener 10 has an odd feeling when hearing the sounds. This is because even if the sounds simultaneously reach the ears of the listener 10, a virtual sound field generated by the first speaker group 51*s* and a virtual sound field generated by the second speaker group 52*s* do not exactly match, which causes the sound fields to be separated, imbalanced, or lose the sharpness.

In view of this, the audio signal reproduction device 100A according to the present embodiment reduces such an odd feeling using the precedence effect.

Figure 4:
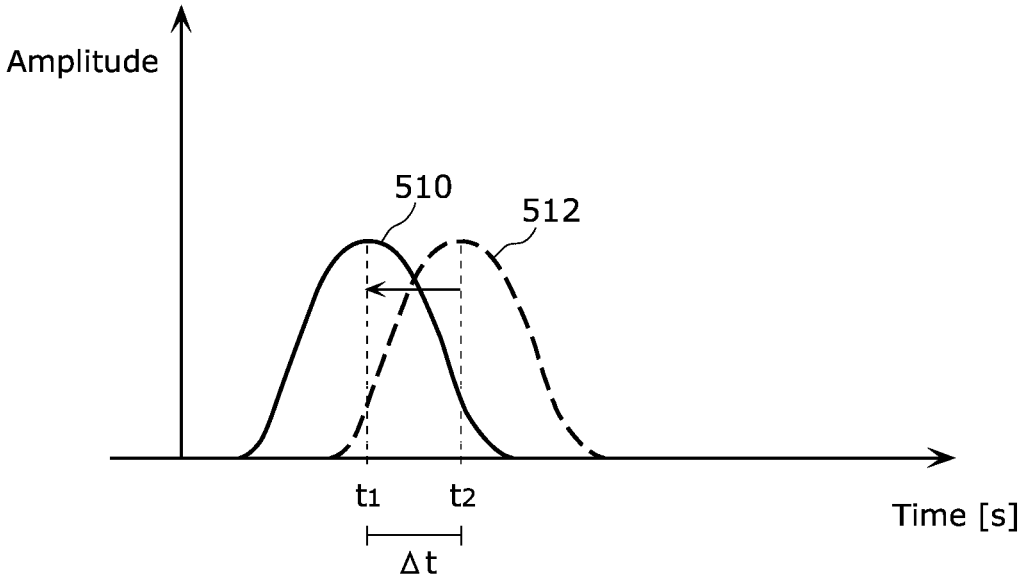
FIG. 4 is a conceptual diagram for describing precedence effect.

FIG. 4 is a conceptual diagram for describing the precedence effect. Here, a waveform 510 represents a waveform of the first sound that has reached the listener 10 at time t1, a waveform 512 represents a waveform of the second sound which is the same as the first sound and has reached the listener 10 at time t2.

The precedence effect is a phenomenon in which when $\Delta t=|t2-t1|$ is included in a predetermined range, sounds are heard as if the localization of the sound source of the second sound that has reached later shifts toward the localization of the sound source of the first sound that has reached earlier. Here, although Δt is different depending on the environment, it is known that about $0<\Delta t<20$ [ms] is satisfied.

Specifically, the audio signal reproduction device 100A controls the difference between times at which the first reproduction signals and the second reproduction signals are output so that a time at which the first sound reaches the listener 10 and a time at which the second sound reaches the listener 10 are different by Δt which allows the precedence effect to occur. This allows a position of the virtual sound source localized by using one of the first sound and the second sound that has reached later to be exactly the same as a position of the virtual sound source localized by using a precedence sound which is the other one of the first sound and the second sound that has reached the listener 10 earlier.

The following describes in more detail sound localization processing by the audio signal reproduction device 100A according to the present embodiment having the above configuration.

Figure 5:
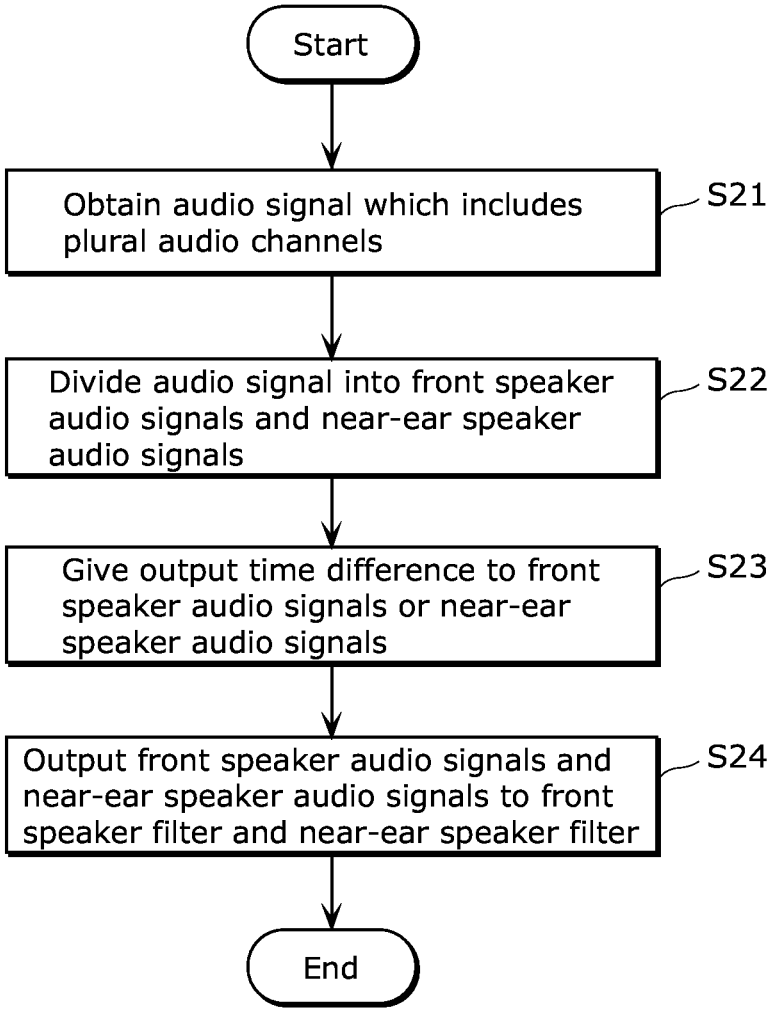
FIG. 5 is a flowchart illustrating an example of operation of the audio signal reproduction device according to Embodiment 1.

FIG. 5 is a flowchart illustrating an example of operation of the audio signal reproduction device 100A according to the present embodiment.

First, the obtaining unit 1 obtains an audio signal which includes plural audio channel signals (S21).

Next, the obtaining unit 1 divides the audio signal including plural audio channel signals and obtained by the obtaining unit 1, into the same audio signals for two types of the speakers (i.e., the first audio signals and the second audio signals) so as to allow the front speakers and the near-ear speakers to separately process the audio signals (S22).

It is not necessarily required to divide an audio signal into the same audio signals for two types of the speakers, and regarding the magnitude of signal values, the ratios of signal values used when dividing an audio signal into the signals may be changed, taking into consideration the distance between a listener and front speakers and the distance between a listener and near-ear speakers, and the ratios of such signal values may be changed taking into consideration the performance of the front speakers and the near-ear speakers, for example.

For example, the ratios may be changed such that the longer the distance between the listener 10 and a speaker is, the larger a signal value is. Further, the ratios may be changed such that the lower the performance of a speaker is, the larger a signal value is.

Further, a difference between times at which the signals for two types of the speakers are output may be controlled so that the phases of front speaker signals and near-ear speaker signals are the same at the position of the listener, taking into consideration the distance between the listener and the front speakers and the distance between the listener and the near-ear speakers, for example.

For example, with reference to FIG. 3, the obtaining unit 1 may control a difference between output times so that the second reproduction signals reach $T_1-T_2$ [s] later.

In the present embodiment, it is assumed in the following that in step S22, the obtaining unit 1 causes the magnitude of signal values to be the same so that the output by the front speakers (the first reproduction sounds) and the output by the near-ear speakers (the second reproduction sounds) are the same at the position of the listener 10 when the listener hears the sounds, and furthermore the obtaining unit 1 divides the same audio signal into two types of signals so that the phases of the output by the front speakers and the output by the near-ear speakers are the same at the position of the listener 10 (in other words, the first sound and the second sound reach the listener 10 simultaneously).

Next, the output time difference control unit 3*a* controls times at which audio channel signals reproduced by the front speakers and the near-ear speakers are output (S23).

Figure 6:
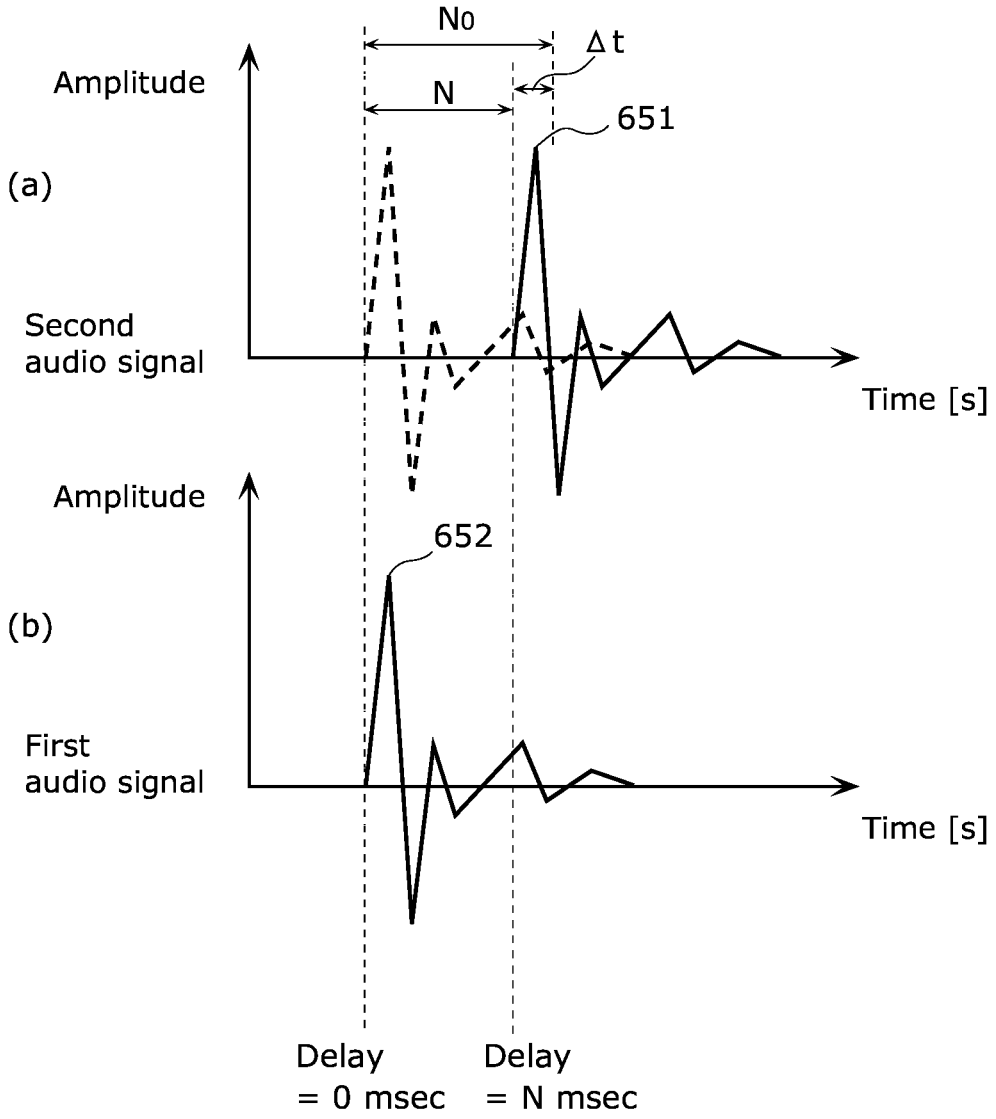
FIG. 6 illustrates a delay of signal values of audio channels reproduced by speakers in the audio signal reproduction device according to Embodiment 1 and a variation thereof.

A more detailed description is given of steps S22 and S23, using (a) of FIG. 6 and (b) of FIG. 6.

Part (a) of FIG. 6 illustrates a waveform of the second reproduction signal given a delay of N [msec] relative to the first reproduction signal, and (b) of FIG. 6 illustrates a waveform of the first reproduction signal. In (a) of FIG. 6, when the second reproduction signal is not delayed, and the phases of the first reproduction signal and the second reproduction signal are the same (N=0), it is indicated that both signals are reproduced simultaneously.

Further, when the second reproduction signal is delayed by $N_0$ relative to the first reproduction signal ($N=N_0$), it is indicated that the listener 10 simultaneously hears reproduced sounds indicated by both signals having the same phase. In the present embodiment, as described above, the obtaining unit 1 divides the obtained audio signal, and thereafter outputs the second reproduction signals after an $N_0$ delay (S22). It should be noted that $N_0=T_1-T_2$, as illustrated in FIG. 3.

The output time difference control unit 3*a* according to the present embodiment controls times at which the first reproduction signals and the second reproduction signals are output so as to increase or decrease an amount of delay for the second reproduction signals by $\Delta t$ relative to $N_0$ (S23). FIG. 6 illustrates the case where control is performed so that the second reproduction signals result in a precedence sound for the listener 10 by setting a delay amount N to $N_0-\Delta t$.

Here, the output time difference control unit 3*a* sets the delay amount N to an appropriate value so that a desired sound field is formed by the front speaker output and the near-ear speaker output. An appropriate delay amount is determined by, for example, previously conducting a subjective evaluation experiment, and varying the delay amount between the front speaker output and the near-ear speaker output, to obtain a delay amount which achieves a desired sound field by the precedence effect.

An excessively large delay amount causes the following problems that the listener separately perceives front speaker signals and near-ear speaker signals, which increases an unpleasant sense of echo, and also separates the sound field created by the front speakers and the sound field created by the near-ear speaker, resulting in a loss of a sense of unity of the sound fields. Therefore, preferably, the delay amount is not excessively large. Specifically, as mentioned above, $0<\Delta t<20$ [msec] may be satisfied, conceivably. It should be noted that more specifically, 2 [msec]$<\Delta t<$8 [msec] may be satisfied according to a result of a subject experiment.

It should be noted that in the present embodiment, to facilitate a description, processing is performed which includes two steps, namely, (1) in step S22, a delay ($N_0$) for eliminating the difference between times at which the first reproduction signals and the second reproduction signals reach the listener 10 is given to the first or second reproduction signals, and thereafter (2) in step S23, the delay amount of the first or second reproduction signals is increased or decreased in order to produce the precedence effect.

However, it is not necessary to divide delay processing into two steps, and the processing may be performed in one step. For example, $N_0$ and $\Delta t$ may be determined previously, and the output time difference control unit 3*a* may control the difference between output times so that the first or second reproduction signals are always output after a delay of $\Delta t_0=N_0-\Delta t$.

Thus, the audio signal reproduction device 100A according to the present embodiment may use, for example, a time longer than 0 milliseconds and shorter than 20 milliseconds, as the predetermined range.

In other words, the output time difference control unit 3*a* may control the difference between times at which the first reproduction signals and the second reproduction signals are output so that the absolute value of a difference between a first time at which the first sound reaches the listener 10 and a second time at which the second sound reaches the listener 10 is greater than 0 milliseconds and less than 20 milliseconds.

More specifically, the output time difference control unit 3*a* may control the difference between times at which the first reproduction signals and the second reproduction signals are output so that the second time comes earlier than the first time by a time longer than 0 milliseconds and shorter than 20 milliseconds. Further, the output time difference control unit 3*a* may control the difference between times at which the first reproduction signals and the second reproduction signals are output so that the first time comes earlier than the second time by a time longer than 0 milliseconds and shorter than 20 milliseconds.

Accordingly, the output time difference control unit 3*a* according to the present embodiment may control the difference between times at which the first reproduction signals and the second reproduction signals are output so that the absolute value of a difference between the first time at which the first sound included in the first reproduction sounds reaches the listener 10 and the second time at which the second sound which is included in the second reproduction sounds and the same as the first sound reaches the listener 10 is greater than 0 milliseconds and less than 20 milliseconds.

Specifically, the output time difference control unit 3*a* may control the difference between times at which the first reproduction signals and the second reproduction signals are output so that the absolute value of a difference between the first time and the second time is greater than 2 milliseconds and less than 8 milliseconds. Further, the output time difference control unit 3*a* may control the difference between times at which the first reproduction signals and the second reproduction signals are output so that the second time comes earlier than the first time by a time longer than 2 milliseconds and shorter than 8 milliseconds.

It should be noted that in the present embodiment, a feature of a localized virtual sound field changes for the listener 10 depending on which of the first sound and the second sound reaches the listener 10 earlier.

Figure 7:
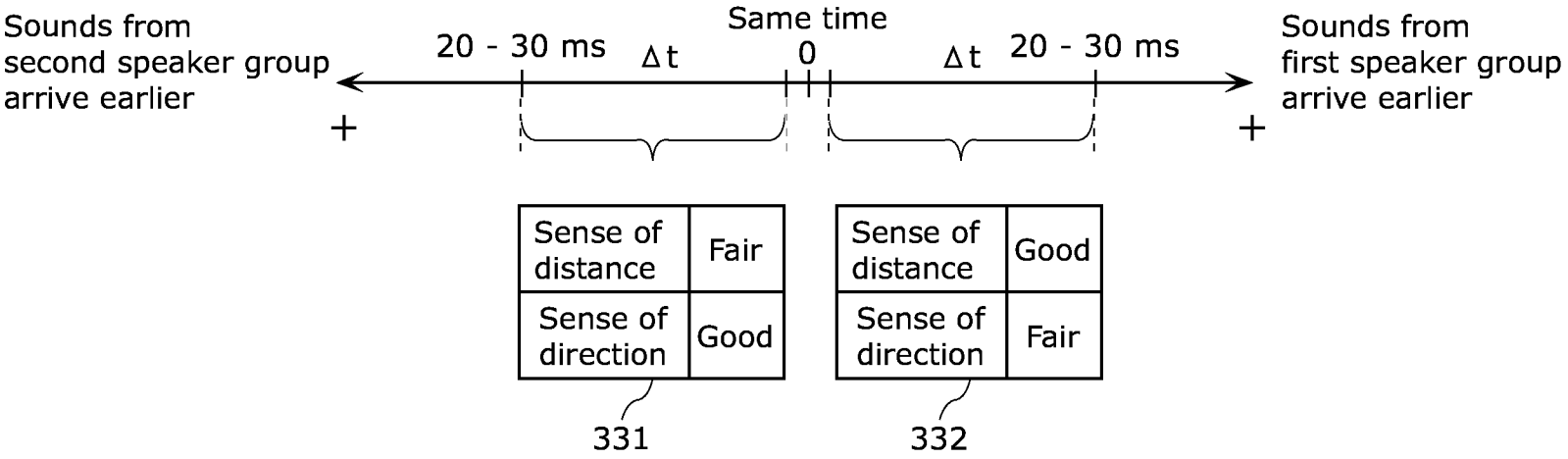
FIG. 7 illustrates influence given on sound localization, depending on sounds from which of two speaker groups reach earlier according to the embodiment and the variation thereof.

FIG. 7 illustrates the influence, on sound field localization, given depending on which sounds from two speaker groups according to the embodiment (the first speaker group 51*s* and the second speaker group 52*s*) reaches earlier.

A table 331 shows features of sound field localization in the case where the second sound reproduced by the second speaker group 52*s* placed near the ears of the listener 10 reaches the listener 10 Δt earlier. As illustrated in the table 331, the virtual sound field localized in this case provides higher accuracy in a sense of direction than a sense of distance.

Further, a table 332 illustrates a tendency of sound field localization in the case where the first sound reproduced by the first speaker group 51*s* placed in front of the listener 10 reaches the listener 10 Δt earlier. As illustrated in the table 332, a virtual sound field localized in this case provides higher accuracy in a sense of distance than a sense of direction.

This is because if a virtual sound field localized by using the sounds reproduced by the first speaker group 51*s* is compared with a virtual sound field localized by using the sounds reproduced by the second speaker group 52*s*, the sounds reproduced by the first speaker group 51*s* provide better localization of a virtual sound field in a sense of distance, whereas the sounds reproduced by the second speaker group 52*s* provide better localization of a virtual sound field in a sense of direction (in particular, a sense of backward direction if the first speaker group 51*s* is in front of the listener 10).

Thus, the audio signal reproduction device 100A according to the present embodiment can reduce, using the precedence effect, an odd feeling when the listener hears sound due to a use of both the first speaker group 51*s* and the second speaker group 52*s*, and in addition, can select, according to a position of each virtual sound field, to which of localization accuracy in a sense of distance and localization accuracy in a sense of direction a priority is to be given, thereby achieving localization of a more natural virtual sound field with higher precision.

For example, with reference to FIG. 2, localization of the virtual sound sources (11, 12, 15) in front of the listener 10 is achieved by the first speaker group 51*s*, and localization of the virtual sound sources (23, 24) behind the listener 10 is achieved by the second speaker group 52*s*, thereby achieving localization in both distance and direction.

Thus, the output time difference control unit 3*a* included in the audio signal reproduction device 100A may control the difference between times at which audio signals are output so that among the audio channel signals included in the first audio signals, a sound included in an audio channel signal corresponding to a virtual sound source to be localized in front of the listener 10 reaches the listener 10 Δt earlier than the same sound included in the second audio signals. Similarly, the output time difference control unit 3*a* may control the difference between times at which audio signals are output so that among audio channel signals included in the second audio signals, a sound included in an audio channel signal corresponding to a virtual sound source to be localized behind the listener 10 reaches the listener 10 Δt earlier than the same sound included in the first audio signals.

In other words, among the first virtual sound positions, if the first position is behind a listener, the virtual sound field generation unit 80A may generate the first reproduction signals and the second reproduction signals so that the second sound reaches a listening position earlier than the first sound. Further, if the first position is in front of the listener, the virtual sound field generation unit 80A may generate the first reproduction signals and the second reproduction signals so that the first sound reaches the listening position earlier than the second sound.

Specifically, the output time difference control unit 3*a* may control output times for all of plural audio channel signals included in front speaker signals and near-ear speaker signals, or may control output times only for a certain audio channel signal. Further, in FIG. 6, a delay is not given to the near-ear speaker signals, whereas a delay is given to the front speaker signals. However, a delay may not be given to the front speaker signals, and a delay may be given to the near-ear speaker signals.

Figure 8:
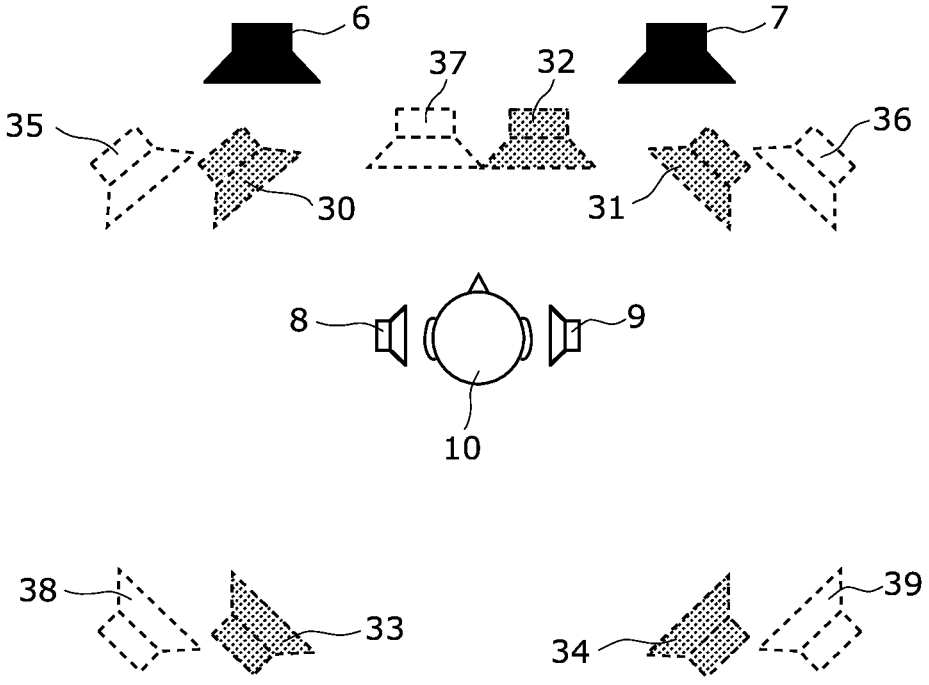
FIG. 8 illustrates a sound field achieved by the audio signal reproduction device according to Embodiment 1 and a variation thereof.

FIG. 8 illustrates an example of plural virtual sounds generated by outputting, from the first speaker group 51*s* and the second speaker group 52*s*, the first reproduction signals and the second reproduction signals for which a difference of output times is controlled by the output time difference control unit 3*a* included in the audio signal reproduction device 100A according to the present embodiment, as described above.

FIG. 8 illustrates a state in which a virtual FL speaker 30, a virtual FR speaker 31, a virtual center channel speaker (virtual C speaker) 32, a virtual SL speaker 33, and a virtual SR speaker 34 are generated by the front L speaker 6 and the front R speaker 7, and a virtual FL speaker 35, a virtual FR speaker 36, a virtual C speaker 37, a virtual SL speaker 38, and a virtual SR speaker 39 are generated by the near-ear L speaker 8 and the near-ear R speaker 9.

It should be noted that although in FIG. 8, 5-channel audio channel signals are to be processed by the audio signal reproduction device 100A, only a certain specific audio channel signal may be processed, as described above.

It should be noted that FIG. 2 illustrates a configuration in which the virtual sound field generation unit 80A includes the output time difference control unit 3*a* upstream relative to the filter processing unit 70, and the filter processing unit 70 performs sound field generation processing on audio channel signals whose output times are made different by the output time difference control unit 3*a*. However, the audio signal reproduction device 100A may not include the output time difference control unit 3*a* upstream relative to the filter processing unit 70, as a different processing unit.

Figure 9:
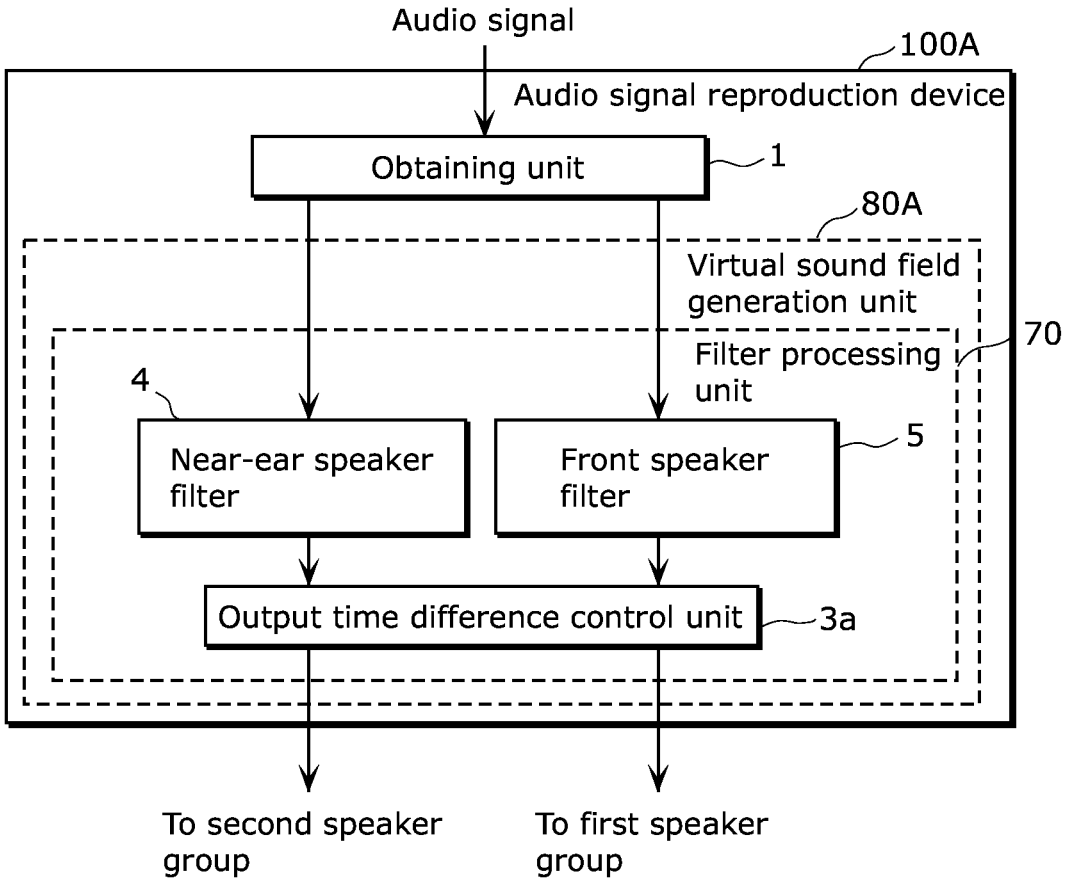
FIG. 9 illustrates another example of the audio signal reproduction device according to Embodiment 1 and the variation thereof.

FIG. 9 is a block diagram illustrating a variation of the audio signal reproduction device 100A according to the present embodiment. In this variation, the output time difference control unit 3*a* is included in the filter processing unit 70.

In other words, the output time difference control unit 3*a* according to this variation is achieved as software united with the near-ear speaker filter 4 and the front speaker filter 5.

Specifically, the near-ear speaker filter 4 and the front speaker filter 5 perform processing of delaying audio channel signals, and also perform sound field generation processing thereon. More specifically, the output time difference control unit 3*a* implements processing by delaying (or advancing) a phase only for elements corresponding to phases of audio channel signals, among elements included in a matrix which shows filter coefficients and is included in each of the near-ear speaker filter 4 and the front speaker filter 5. In this case, in the processing performed inside the filter processing unit 70, processing by the output time difference control unit 3*a* and processing by the near-ear speaker filter 4 and the front speaker filter 5 are executed in random order.

Thus, the same or similar effects are achieved both when the output time difference control unit 3*a* is provided upstream relative to the filter processing unit 70, and when the output time difference control unit 3*a* is achieved as part of the configuration of the filter processing unit 70, as illustrated in FIG. 9.

It should be noted that the first speaker group may not be necessarily placed in front of the listener 10. For example, the first speaker group may be placed behind the listener 10. In this case, the output time difference control unit 3*a* controls the difference between output times so that reproduction sounds indicated by the first audio signals reach the listener 10 earlier than reproduction sounds indicated by the second audio signals, thereby improving localization accuracy in a sense of distance to a further back position.

As described above, according to the audio signal reproduction device 100A according to the present embodiment, the audio signal reproduction device controls an obtained audio signal so that reproduced sounds reach a listener with an interval of a very short time in a predetermined range when the first speaker group (for example, front speakers) reproduces sounds and when the second speaker group (for example, near-ear speakers) reproduces sounds. Accordingly, the listener will hear two sounds to which the precedence effect is given. As a result, although the times are different at which the listener hears the sounds, the listener hears the sounds as if a virtual sound field localized by using the sound which has reached later matches a virtual sound field localized by using the sound which has reached earlier. Furthermore, the listener strongly perceives the sound which has reached earlier than the sound which has reached later. Thus, an odd feeling can be reduced when the listener hears sound, which is caused by virtual sound fields generated by the front speakers and the near-ear speakers being separated, imbalanced, or losing sharpness. Furthermore, the advantage obtained when outputting a sound from a front speaker and the advantage obtained when outputting a sound from a near-ear speaker can be utilized.

Embodiment 2

Next is a detailed description of an embodiment, as Embodiment 2, in which a virtual sound field generation unit generates first reproduction signals and second reproduction signals so that sound pressure values of a first sound and a second sound differ from each other at a listening position.

Figure 10:
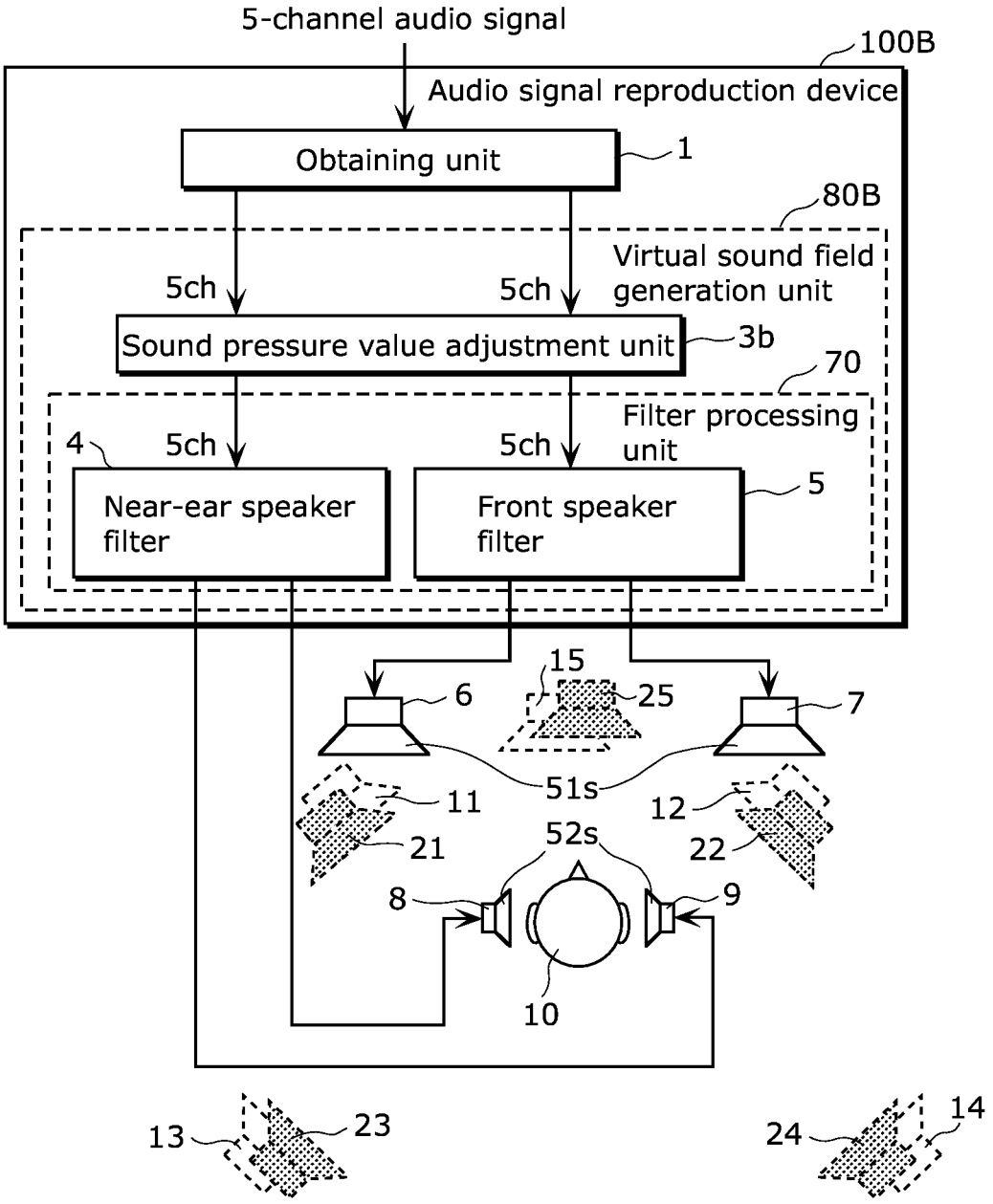
FIG. 10 is a block diagram illustrating a configuration of the audio signal reproduction device according to Embodiment 2.

FIG. 10 is a block diagram illustrating a configuration of an audio signal reproduction device 100B according to the present embodiment.

The audio signal reproduction device 100B according to the present embodiment outputs audio signals on which sound field generation processing has been performed, to front speakers 51*s* (hereinafter, also referred to as a first speaker group 51*s*) which are plural speakers placed in the vicinity of a listener 10, and near-ear speakers 52*s* (hereinafter, also referred to as a second speaker group 52*s*) which are plural speakers placed closer to a listener than the first speaker group 51*s* is.

As illustrated in FIG. 10, the audio signal reproduction device 100B includes an obtaining unit 1 and a virtual sound field generation unit 80B.

The obtaining unit 1 obtains an audio signal which includes plural audio channel signals. Although a description is given in the present embodiment of a 5-channel audio signal (in other words, an audio signal which includes five audio channel signals) as an example, the number of audio channel signals is not limited to this. For example, an audio signal which includes given audio channel signals such as a 2-channel, 4-channel, or 7-channel audio signal may be input.

Further, the obtaining unit 1 generates, from the obtained audio signal, first audio signals to be reproduced as first reproduction sounds by the first speaker group 51*s*, and second audio signals to be reproduce as second reproduction sounds by the second speaker group 52*s*. Specifically, the first audio signals and the second audio signals each include 5-channel audio channel signals.

The virtual sound field generation unit 80B performs sound field generation processing on the first audio signals and the second audio signals so that a third speaker group which includes virtual sound sources corresponding to plural audio channel signals is localized at predetermined positions by using the first reproduction sounds, and a fourth speaker group which includes plural virtual sound sources different from the third speaker group and corresponding to plural audio channel signals is localized at predetermined positions by using the second reproduction sounds.

Specifically, the virtual sound field generation unit 80B performs sound field generation processing so that a sound pressure value of each virtual sound source included in the third speaker group and the fourth speaker group is equal to a sound pressure value obtained by multiplying an audio channel signal corresponding to the virtual sound source by a gain corresponding to the audio channel signal. More specifically, the virtual sound field generation unit 80B generates the first reproduction signals and the second reproduction signals so that sound pressure values of a first sound and a second sound are different at a listening position, the first sound being indicated by the first reproduction signals, and localized at a first position among first virtual sound positions, the second sound being indicated by the second reproduction signals, localized at substantially the same position as the first position, included in the second reproduction signals, and having substantially the same feature as the first sound. A detailed description will be given below.

The virtual sound field generation unit 80B has a sound pressure value adjustment unit 3*b* and a filter processing unit 70.

The sound pressure value adjustment unit 3*b* adjusts sound pressure values by multiplying each of plural audio channel signals by a corresponding gain.

The filter processing unit 70 performs filter processing on the first audio signals so that the third speaker group is localized by using the first reproduction sounds, and performs filter processing on the second audio signals so that the fourth speaker group is localized by using the second reproduction sounds. Here, the third speaker group and the fourth speaker group are localized at the same position. Specifically, the filter processing unit 70 changes a frequency amplitude response and a phase response, for each of plural audio channel signals included in the first audio signals and the second audio signals. Detailed processing by the filter processing unit 70 is determined based on an HRTF according to the related art described above, and thus a description thereof is omitted.

The filter processing unit 70 includes a near-ear speaker filter 4 and a front speaker filter 5.

The front speaker filter 5 performs filter processing on the first audio signals so that the third speaker group (virtual sound sources 11 to 15 described below) is localized at a predetermined position by using the first reproduction sounds.

The near-ear speaker filter 4 performs filter processing on the second audio signals so that the fourth speaker group (virtual sound sources 21 to 25 described below) is localized at a predetermined position by using the second reproduction sounds.

It should be noted that although there is a difference between positions of the third speaker group and the fourth speaker group in FIG. 10 to facilitate illustration, the groups may be localized at the same position or different positions corresponding to the audio channel signals, in practice. The following describes the case where the groups are localized at the same position.

Via the audio signal reproduction device 100B having the configuration as illustrated in FIG. 10, by hearing sounds reproduced by a first speaker group which includes a front L speaker 6 and a front R speaker 7 and a second speaker group which includes a near-ear L speaker 8 and a near-ear R speaker 9, the listener 10 hears reproduced sounds from positions of virtual FL speakers 11 and 21, virtual FR speakers 12 and 22, virtual SL speakers 13 and 23, virtual SR speakers 14 and 24, and virtual C speakers 15 and 25, which are virtual sound sources that do not actually exist.

However, as described above, if the virtual sound sources are localized using the first reproduction sounds reproduced by the first speaker group and the second reproduction sounds reproduced by the second speaker group, and the same sound for localizing the same virtual sound source is reproduced at the same gain, the listener has an odd feeling when hearing the sounds. Thus, the gain balance of the plural virtual sound sources as a whole is not appropriate, and thus the sound fields formed by the virtual sound sources are imbalanced, thereby creating an unnatural sound field. Furthermore, a virtual sound field localized by using the first or second speaker group is dominant, thereby separating sound fields.

In view of this, in the audio signal reproduction device 100B according to the present embodiment, the virtual sound field generation unit 80B sets a gain for each audio channel signal corresponding to a virtual sound field, thereby solving the above problems.

The following is a further detailed description of sound localization processing by the audio signal reproduction device 100B having the above configuration according to the present embodiment.

Figure 11:
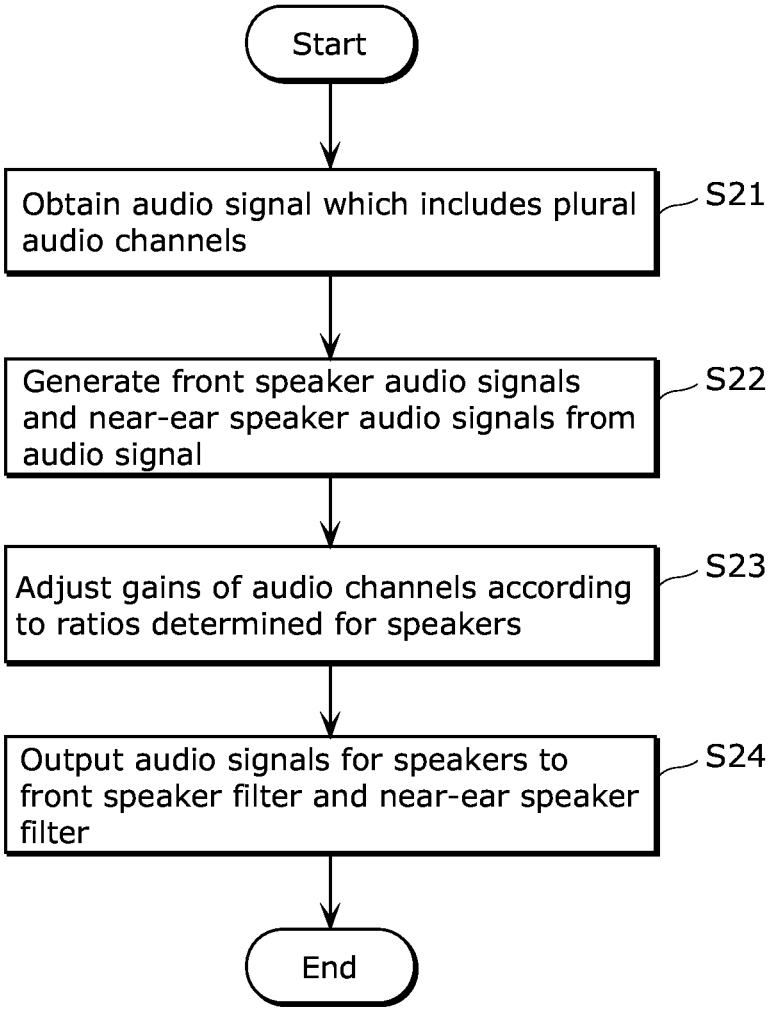
FIG. 11 is a flowchart illustrating an example of operation of the audio signal reproduction device according to Embodiment 2.

FIG. 11 is a flowchart illustrating an example of operation of the audio signal reproduction device 100B according to the present embodiment.

First, the obtaining unit 1 obtains an audio signal which includes plural audio channel signals (S21).

Next, the obtaining unit 1 generates the same audio signals for two types of the speakers (specifically, the first audio signals and the second audio signals) so that the front speakers 51*s* and the near-ear speakers 52*s* separately process and reproduce the obtained audio signal which includes the plural audio channel signals (S22).

It is not necessarily required to generate the same audio signals for two types of the speakers. For example, gains of signal values used when generating the signals may be changed, taking into consideration a distance between a listener and the front speakers 51*s* and a distance between a listener and the near-ear speakers 52*s*, or changed, taking into consideration the performance of the front speakers 51*s* and the near-ear speakers 52*s*. Alternatively, the gains of signal values of plural audio channel signals may be changed separately. Here, a signal value means a sound pressure value which is a value indicating the magnitude of a sound pressure designated in each audio channel signal.

For example, gains may be changed such that the greater the distance between the listener 10 and a speaker is, the greater a signal value is. Further, gains may be changed such that the lower the performance of a speaker is, the greater a signal value is.

To facilitate a description, the following in the present embodiment describes a case in which the same audio signals for two types of the speakers are generated which have signal values causing the output of the front speakers 51*s* and the output of the near-ear speakers 52*s* to be the same when the listener 10 hears sounds at the position of the listener 10.

Next, sound pressure values of audio channel signals reproduced by the front speakers 51*s* and the near-ear speakers 52*s* are adjusted (S23). A description is given of a specific adjustment method, using FIG. 12.

FIG. 12 illustrates gains of audio channel signals previously determined for the front speakers and for the near-ear speakers, and stored by the sound pressure value adjustment unit 3*b* according to the present embodiment. More specifically, FIG. 12 illustrates gains of 5-channel audio signals (FL signal, FR signal, C signal, SL signal, and SR signal) output to the front speakers 51*s*, and gains of 5-channel audio signals (FL signal, FR signal, C signal, SL signal, and SR signal) output to the near-ear speakers 52*s*.

As described above, gains indicate the degree of increase or decrease from sound pressure values included in the first audio signals and the second audio signals obtained by the sound pressure value adjustment unit 3*b* (hereinafter, the sound pressure values are also referred to as fixed sound pressure values). Here, if a gain is 1, the sound pressure value adjustment unit 3*b* outputs a sound pressure value of a corresponding audio channel signal as it is (i.e., an as-is sound pressure value included in an audio signal obtained by the obtaining unit 1). If a gain is 0, the sound pressure value adjustment unit 3*b* does not output a corresponding audio channel signal. If a gain exceeds 1, the sound pressure value adjustment unit 3*b* adjusts a sound pressure value of a corresponding audio channel signal so that the sound pressure value is greater than the sound pressure value originally included, and outputs the resultant value. In contrast, if a gain is greater than 0 and less than 1, the sound pressure value adjustment unit 3*b* adjusts a sound pressure value of a corresponding audio channel signal so that the sound pressure value is smaller than the sound pressure value originally included, and outputs the resultant value.

It should be noted that even if a gain is 2, the sound pressure value adjustment unit 3*b* does not necessarily need to adjust a sound pressure value to double the sound pressure value. For example, assuming that a given real number is R, and the value of a gain is G, the sound pressure value adjustment unit 3*b* may multiply a sound pressure value by G×R. Further, when a gain is 2, a sound pressure value may be obtained by multiplying a fixed sound pressure value by a, whereas when a gain is 3, a sound pressure value may be obtained by multiplying a fixed sound pressure value by b. Here, a is smaller than b.

Specifically, the value of each gain stored by the sound pressure value adjustment unit 3*b* may be any of an ordinal scale, an interval scale, and a ratio scale.

Cases 1 to 6 corresponding to columns in FIG. 12 show cases where sound pressure values of audio channel signals are adjusted by using respective gains, and reproduced by the speakers. It should be noted that case 7 shows a combination of gains which is not set by the sound pressure value adjustment unit 3*b* according to the present embodiment.

The following is a description of the cases.

In case 1, among front speaker audio channel signals included in the first audio signals, an FL signal, an FR signal, and a C signal have a gain of 1, and thus are each reproduced at a fixed sound pressure value, and an SL signal and an SR signal have a gain of 0, and thus are not reproduced, resulting in silence.

Similarly, among near-ear speaker audio channel signals included in the second audio signals, an FL signal, an FR signal, and a C signal have a gain of 0, and thus are not reproduced, resulting in silence, and an SL signal and an SR signal have a gain of 1, and thus are each reproduced at a fixed sound pressure value. Specifically, as front speaker signals, the FL signal, the FR signal, and the C signal each having a gain of 1 are output, and as near-ear speaker signals, the SL signal and the SR signal each having a gain of 1 are output.

Figure 13:
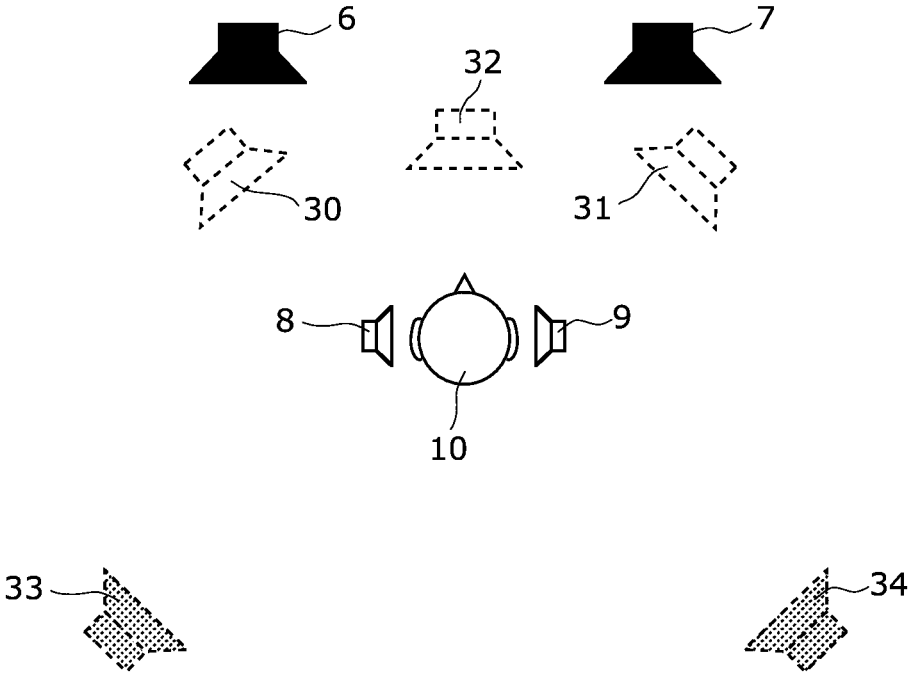
FIG. 13 illustrates a sound field achieved in case 1 of the audio signal reproduction device according to Embodiment 2 and the variation thereof.

Therefore, the FL signal, the FR signal, and the C signal which are front speaker signals, and the SL signal and the SR signal which are near-ear speaker signals all have a gain of 1, and thus the gains are the same. Accordingly, the signals are output which have signal values whose gains are the same. FIG. 13 illustrates a sound field generated by outputting the front speaker signals having signal values adjusted in the above manner to the front speaker filter 5, and the near-ear speaker signals having thus adjusted signal values to the near-ear speaker filter 4 (S24).

In FIG. 13, a virtual FL speaker 30, a virtual FR speaker 31, and a virtual C speaker 32 are localize by using the first reproduction sounds reproduced by the front L speaker 6 and the front R speaker 7. Further, a virtual SL speaker 33 and a virtual SR speaker 34 are localized by using the second reproduction sounds reproduced by the near-ear L speaker 8 and the near-ear R speaker 9.

Although the actual speakers which generate such a sound field are the front L speaker 6, the front R speaker 7, the near-ear L speaker 8, and the near-ear R speaker 9, the listener 10 perceives virtual sound sources each outputting the same signal value at (1) the positions of the virtual FL speaker 30, the virtual FR speaker 31, and the virtual C speaker 32 which are localized by using the front L speaker 6 and the front R speaker 7, and (2) the positions of the virtual SL speaker 33 and the virtual SR speaker 34 which are localized by using the near-ear L speaker 8 and the near-ear R speaker 9.

Next, in case 2, among front speaker audio channel signals, a gain of 1 is designated for all of the FL signal, the FR signal, the C signal, the SL signal, and the SR signal. Similarly, among near-ear speaker audio channel signals, a gain of 1 is designated for the FL signal, the FR signal, and the C signal, and a gain of 2 is designated for the SL signal and the SR signal. In other words, as front speaker signals, the FL signal, the FR signal, the C signal, the SL signal, and the SR signal each having a gain of 1 are output. Further, as near-ear speaker signals, the FL signal, the FR signal, and the C signal each having a gain of 1 are output, and the SL signal and the SR signal each having a gain of 2 are output.

Figure 14:
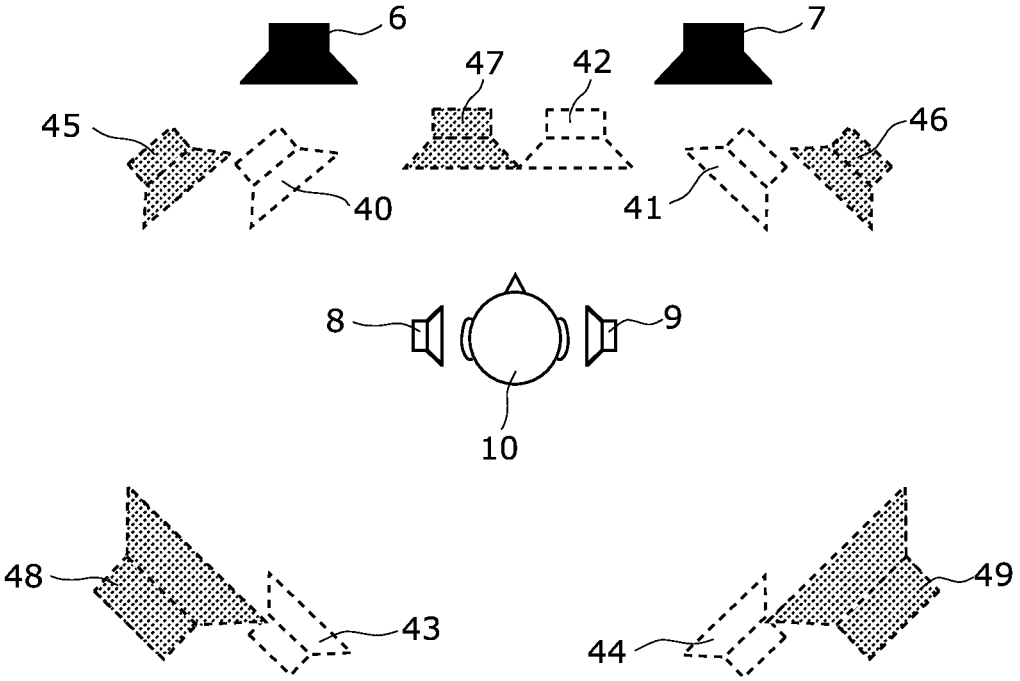
FIG. 14 illustrates a sound field achieved in case 2 of the audio signal reproduction device according to Embodiment 2 and the variation thereof.

FIG. 14 illustrates a sound field generated by outputting the front speaker signals having signal values adjusted in the above manner to the front speaker filter 5, and the near-ear speaker signals having thus adjusted signal values to the near-ear speaker filter 4 (S24).

In FIG. 14, a virtual FL speaker 40, a virtual FR speaker 41, a virtual C speaker 42, a virtual SL speaker 43, and a virtual SR speaker 44 are localize by using the first reproduction sounds reproduced by the front L speaker 6 and the front R speaker 7. Further, a virtual FL speaker 45, a virtual FR speaker 46, a virtual C speaker 47, a virtual SL speaker 48, and a virtual SR speaker 49 are localized by using the second reproduction sounds reproduced by the near-ear L speaker 8 and the near-ear R speaker 9.

Although the actual speakers which generate such a sound field are the front L speaker 6, the front R speaker 7, the near-ear L speaker 8, and the near-ear R speaker 9, the listener 10 perceives virtual sound sources at (1) the positions of the virtual FL speaker 40, the virtual FR speaker 41, the virtual C speaker 42, the virtual SL speaker 43, and the virtual SR speaker 44 which are localized by using the front L speaker 6 and the front R speaker 7, and (2) the positions of the virtual FL speaker 45, the virtual FR speaker 46, the virtual C speaker 47, the virtual SL speaker 48, and the virtual SR speaker 49 which are localized by using the near-ear L speaker 8 and the near-ear R speaker 9.

Here, the gains of signal values to be used for localizing the virtual SL speaker 48 and the virtual SR speaker 49 by using the near-ear L speaker 8 and the near-ear R speaker 9 are "2", and thus in particular, the near-ear speakers 52*s* can cause back virtual sound sources to be perceived with emphasis.

Next, in case 3, among front speaker audio channel signals, a gain of "2" is designated for the FL signal, the FR signal, and the C signal. Further, a gain of "1" is designated for the SL signal and the SR signal. Similarly, among near-ear speaker audio channel signals, a gain of "1" is designated for the FL signal, the FR signal, and the C signal. Further, a gain of "2" is designated for the SL signal and the SR signal.

Specifically, as front speaker signals, the FL signal, the FR signal, and the C signal each having a gain of "2" are output, and the SL signal and the SR signal each having a gain of "1" are output. Further, as near-ear speaker signals, the FL signal, the FR signal, and the C signal each having a gain of "1" are output, and the SL signal and the SR signal each having a gain of "2" are output.

Figure 15:
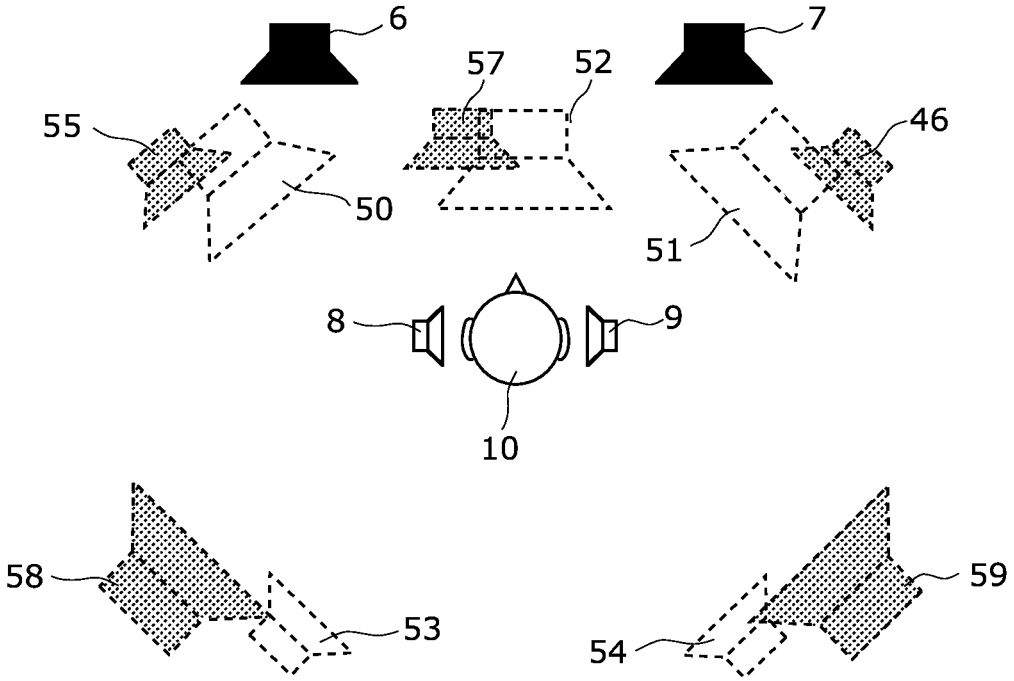
FIG. 15 illustrates a sound field achieved in case 3 of the audio signal reproduction device according to Embodiment 2 and the variation thereof.

FIG. 15 illustrates a sound field generated by outputting the front speaker signals having signal values adjusted in the above manner to the front speaker filter 5, and the near-ear speaker signals having thus adjusted signal values to the near-ear speaker filter 4.

In FIG. 15, a virtual FL speaker 50, a virtual FR speaker 51, a virtual C speaker 52, a virtual SL speaker 53, and a virtual SR speaker 54 are localized by using the first reproduction sounds reproduced by the front L speaker 6 and the front R speaker 7. Further, a virtual FL speaker 55, a virtual FR speaker 56, a virtual C speaker 57, a virtual SL speaker 58, and a virtual SR speaker 59 are localize by using the second reproduction sounds reproduced by the near-ear L speaker 8 and the near-ear R speaker 9.

Although the actual speakers which generate such a sound field are the front L speaker 6, the front R speaker 7, the near-ear L speaker 8, and the near-ear R speaker 9, the listener 10 perceives virtual sound sources at (1) the positions of the virtual FL speaker 50, the virtual FR speaker 51, the virtual C speaker 52, the virtual SL speaker 53, and the virtual SR speaker 54 which are localized by using the front L speaker 6 and the front R speaker 7, and (2) the positions of the virtual FL speaker 55, the virtual FR speaker 56, the virtual C speaker 57, the virtual SL speaker 58, and the virtual SR speaker 59 which are localized by using the near-ear L speaker 8 and the near-ear R speaker 9.

Here, gains of the signal values used by the front L speaker 6 and the front R speaker 7 in order to achieve localization of the virtual FL speaker 50 and the virtual FR speaker 51 and gains of the signal values used by the near-ear L speaker 8 and the near-ear R speaker 9 in order to achieve localization of the virtual SL speaker 58 and the virtual SR speaker 59 are all "2". Thus, in particular, virtual sound sources in front of the listener 10 localized by using the front speakers 51*s*, and virtual sound sources behind the listener 10 localized by using the near-ear speakers 52*s* can be perceived with emphasis.

Next, in case 4, among front speaker audio channel signals, a gain of "2" is designated for the FL signal, the FR signal, and the C signal, and a gain of "1" is designated for the SL signal and the SR signal. Similarly, among near-ear speaker audio channel signals, a gain of "1" is designated for the FL signal, the FR signal, the C signal, the SL signal, and the SR signal. In other words, as front speaker signals, the FL signal, the FR signal, and the C signal each having a gain of "2" are output, and the SL signal and the SR signal each having a gain of "1" are output. Further, as near-ear speaker signals, the FL signal, the FR signal, the C signal, the SL signal, and the SR signal each having a gain of "1" are output.

Figure 16:
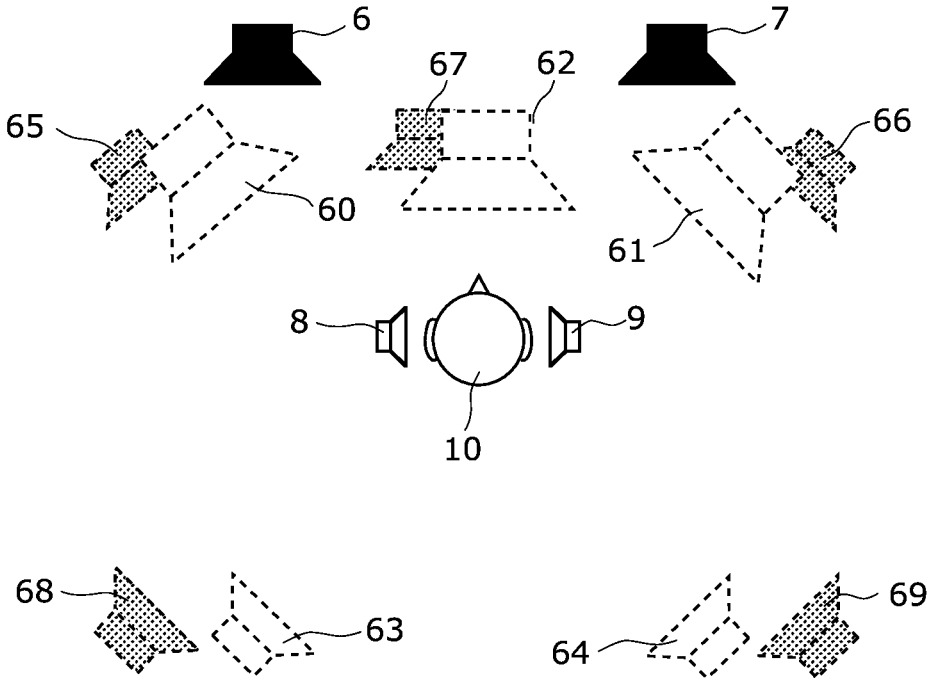
FIG. 16 illustrates a sound field achieved in case 4 of the audio signal reproduction device according to Embodiment 2 and the variation thereof.

FIG. 16 illustrates a sound field generated by outputting the front speaker signals having signal values adjusted in the above manner to the front speaker filter 5, and the near-ear speaker signals having thus adjusted signal values to the near-ear speaker filter 4 (S24).

In FIG. 16, a virtual FL speaker 60, a virtual FR speaker 61, a virtual C speaker 62, a virtual SL speaker 63, and a virtual SR speaker 64 are localized by using the first reproduction sounds reproduced by the front L speaker 6 and the front R speaker 7. Further, a virtual FL speaker 65, a virtual FR speaker 66, a virtual C speaker 67, a virtual SL speaker 68, and a virtual SR speaker 69 are localized by using the second reproduction sounds reproduced by the near-ear L speaker 8 and the near-ear R speaker 9.

Although the actual speakers which generate such a sound field are the front L speaker 6, the front R speaker 7, the near-ear L speaker 8, and the near-ear R speaker 9, the listener 10 perceives virtual sound sources at (1) the positions of the virtual FL speaker 60, the virtual FR speaker 61, the virtual C speaker 62, the virtual SL speaker 63, and the virtual SR speaker 64 which are localized by using the front L speaker 6 and the front R speaker 7, and (2) the positions of the virtual FL speaker 65, the virtual FR speaker 66, the virtual C speaker 67, the virtual SL speaker 68, and the virtual SR speaker 69 which are localized by using the near-ear L speaker 8 and the near-ear R speaker 9.

Here, the gains of signal values used by the front L speaker 6 and the front R speaker 7 in order to localize the virtual FL speaker 60 and the virtual FR speaker 61 are "2", and thus in particular, the front speakers 51*s* can cause the front virtual sound sources to be perceived with emphasis.

It should be noted that cases 1 to 6 respectively illustrated in FIGS. 13 to 16 show examples of gains in the audio signal reproduction device 100B according to the present embodiment, and thus gains for signal values of audio channel signals for the speakers are not limited to these.

Specifically, the virtual sound field generation unit 80B according to the present embodiment may perform sound field generation processing on the first audio signals and the second audio signals so that (1) the gain of an audio channel signal corresponding to a first virtual sound source that is at least one virtual sound source included in the third speaker group and (2) the gain of an audio channel signal corresponding to a virtual sound source that is at least one virtual sound source included in the fourth speaker group and localized at the same position as the first virtual sound source are different from each other.

Further, the virtual sound field generation unit 80B according to the present embodiment may perform sound field generation processing so that a gain of an audio channel signal corresponding to at least one virtual sound source included in at least one of the third speaker group and the fourth speaker group differs from a gain of an audio channel signal corresponding to another virtual sound source included in the at least one speaker group.

The following describes examples of the limit of gains used by the virtual sound field generation unit 80B according to the present embodiment, with reference to cases 5 and 6 illustrated in FIG. 12.

In case 5 in FIG. 12, a gain of "1" is designated for all the audio channel signals included in front speaker audio signals. Further, a gain of "2" is designated for all the audio channel signals included in near-ear speaker audio signals. In other words, the virtual sound field generation unit 80B according to the present embodiment may perform sound field generation processing so that all the audio channel signals in the first audio signals have the same gain, and all the audio channel signals in the second audio signals also have the same gain while the gains of the audio channel signals corresponding to the first audio signals and the second audio signals are different.

Further, in case 6 in FIG. 12, regarding gains of audio channel signals included in front speaker audio signals, a gain of 2 is designated for the C signal, and a gain of 1 is designated for other signals. Also, regarding gains of audio channel signals included in the near-ear speaker audio signals, a gain of 2 is designated for the C signal, and a gain of 1 is designated for other signals. In other words, the virtual sound field generation unit 80B according to the present embodiment may perform sound field generation processing so that among the first audio signals and the second audio signals, the gains of corresponding audio channel signals are the same, whereas the gains of all the audio channel signals included in the first audio signals are not the same, and also the gains of all the audio channel signals included in the second audio signals are not the same.

It should be noted that case 7 in FIG. 12 shows the gains used by an audio signal reproduction device according to the related art. Specifically, the audio signal reproduction device according to the related art does not include the sound pressure value adjustment unit 3*b*, and outputs signals without setting a gain for each audio channel signal.

It should be noted that case 3 is the most preferable among cases 1 to 7 illustrated in FIG. 12.

Specifically, the virtual sound field generation unit 80B may perform the sound field generation processing on the first audio signals so that among the plural virtual sound sources included in the third speaker group, the gain of an audio channel signal corresponding to a virtual sound source localized in front of the listener 10 is greater than the gain of an audio channel signal corresponding to a virtual sound source localized behind the listener 10. In other words, the virtual sound field generation unit 80B may generate the first reproduction signals so that among sounds localized at the first virtual sound positions, a sound pressure value of a sound localized in front of a listener is greater than a sound pressure value of a sound localized behind the listener.

This is because a more exact sound field can be localized if a virtual sound source localized in front of the listener 10 is localized by using the first reproduction sounds from the first speaker group 51*s* that includes speakers placed in front of the listener 10.

Further, the virtual sound field generation unit 80B may perform the sound field generation processing on the second audio signals so that among plural virtual sound sources included in the fourth speaker group, the gain of an audio channel signal corresponding to a virtual sound source localized behind the listener 10 is greater than the gain of an audio channel signal corresponding to a virtual sound source localized in front of the listener 10. In other words, the virtual sound field generation unit 80B may generate the second reproduction signals so that among sounds localized at the second virtual sound positions, a sound pressure value of a sound localized behind a listener is greater than a sound pressure value of a sound localized in front of the listener.

This is because a more exact sound field can be localized if a virtual sound source localized behind the listener 10 is localized by using the second reproduction sounds from the second speaker group 52*s* that includes speakers placed near the ears of the listener 10.

As described above, in the present embodiment, the virtual sound field generation unit 80B can change a gain for each audio channel signal corresponding to a virtual sound source to be localized, and generate a virtual sound field. Specifically, for each virtual sound source, a sound pressure value of a sound reproduced by a virtual sound source can be changed, and the gain balance as the whole virtual sound field can be adjusted. As a result, this reduces imbalance and separation of sound fields due to virtual sounds generated by the first speaker group and the second speaker group.

Further, for example, according to the gains illustrated in cases 1 and 2 in FIG. 12, the audio signal reproduction device 100B can achieve localization of, in particular, a virtual sound source to be localized behind the listener 10 by using the second speaker group 52*s*. Accordingly, the audio signal reproduction device 100B can improve the localization accuracy of a back virtual sound, compared with a front virtual surround system in which only a front speaker is used and which provides low localization accuracy of a back virtual sound source.

Further, based on the gains shown by case 3 in FIG. 12, the audio signal reproduction device 100B can achieve localization of a further exact sound field by achieving localization of a virtual sound source to be localized in front of the listener 10 by using the first speaker group 51*s* that includes speakers placed in front of the listener 10, and localization of a virtual sound source to be localized behind the listener 10 by using the second speaker group 52*s* that includes speakers placed near the ears of the listener 10.

It should be noted that the sound pressure value adjustment unit 3*b* may determine a gain to be used in response to an instruction from the listener 10 obtained via a user interface included separately (not illustrated). For example, it may be determined which of cases 1 to 6 illustrated in FIG. 12 is to be used according to an instruction from the listener 10. Further, the listener 10 may input gains of the audio channel signals via the user interface (not illustrated), and the sound pressure value adjustment unit 3*b* may store the input gains as a new case.

It should be noted that the sound pressure value adjustment unit 3*b* does not necessarily need to store values of gains associated with the audio channel signals as illustrated in FIG. 12, and for example, the sound pressure value adjustment unit 3*b* may obtain gains from an external storage storing gains therein.

It should be noted that the sound pressure value adjustment unit 3*b* according to the present embodiment can be achieved using plural amplifiers.

Figure 17:
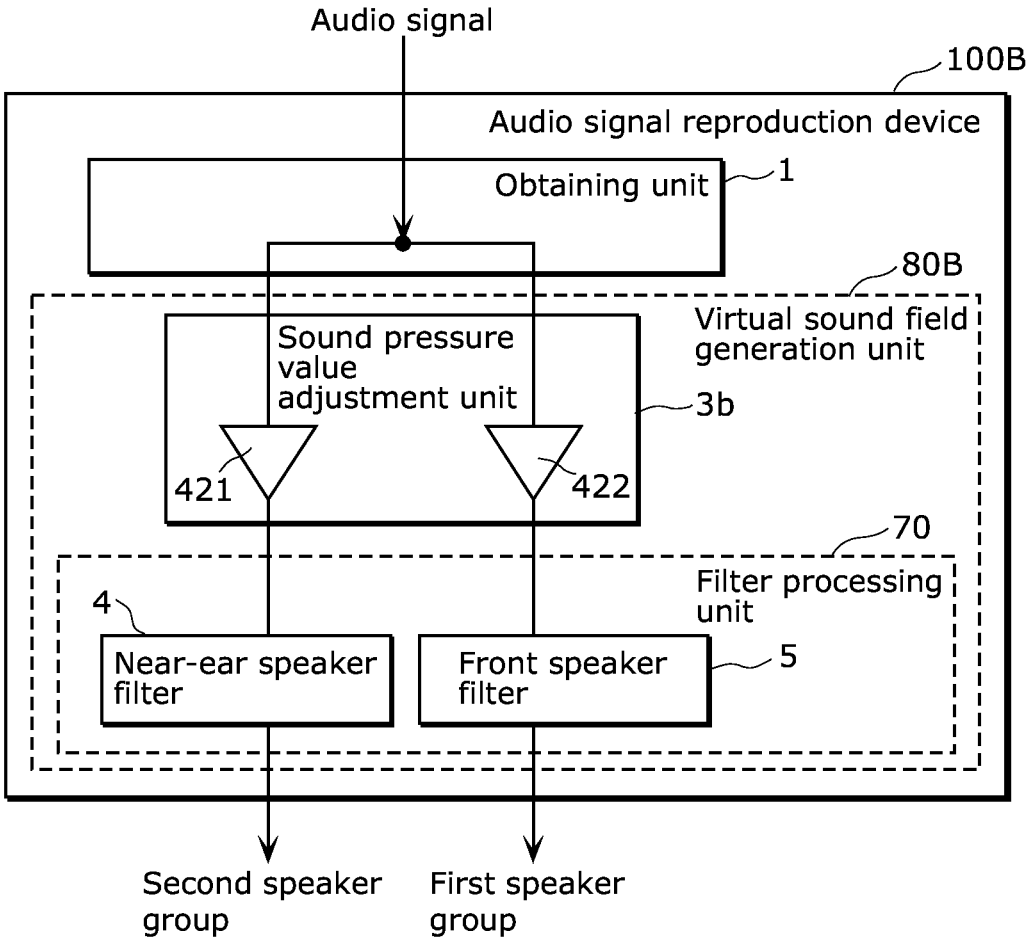
FIG. 17 illustrates an example of a further detailed configuration of the audio signal reproduction device according to Embodiment 2.

FIG. 17 is a block diagram illustrating an example of a more detailed configuration of the sound pressure value adjustment unit 3*b* according to the present embodiment. As illustrated in FIG. 17, according to gains of audio channel signals for the speakers, the sound pressure value adjustment unit 3*b* having a function of variably controlling signal values may include an amplifier 421 and an amplifier 422 which can variably control signal values according to gains of audio channel signals for the speakers. Here, specifically, the amplifiers 421 and 422 are electronic circuits which amplify a voltage, a current, or power of an input signal, and output the amplified result.

It should be noted that FIG. 17 illustrates a configuration in which the virtual sound field generation unit 80B includes the sound pressure value adjustment unit 3*b* upstream relative to the filter processing unit 70, and the filter processing unit 70 performs sound field generation processing on the first audio signals and the second audio signals whose sound pressure values are adjusted by the sound pressure value adjustment unit 3*b*. However, the audio signal reproduction device 100B does not necessarily need to include, as a separate processing unit, the sound pressure value adjustment unit 3*b* upstream relative to the filter processing unit 70.

Figure 18:
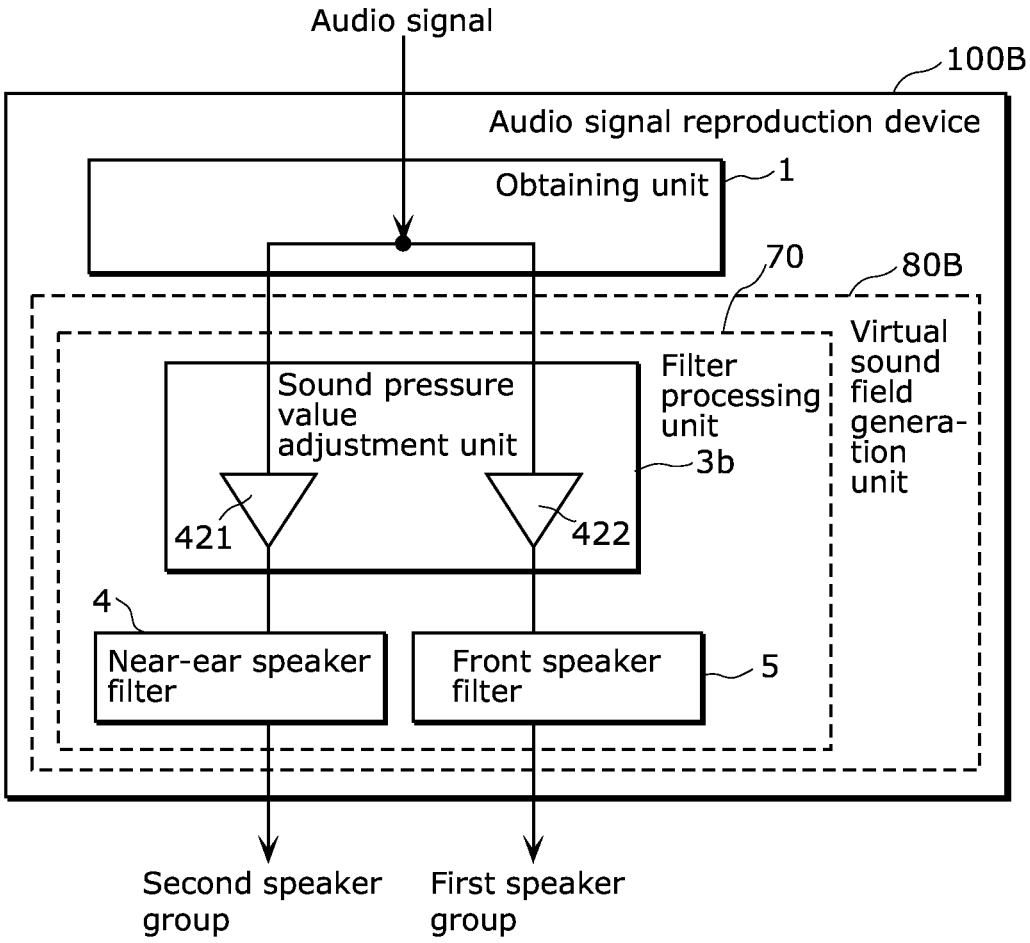
FIG. 18 illustrates a further detailed configuration of the audio signal reproduction device according to the variation of Embodiment 2.

FIG. 18 is a block diagram illustrating a more detailed configuration of an audio signal reproduction device according to a variation of the present embodiment. As illustrated in FIG. 18, the obtaining unit 1 generates audio signals for two types of the speakers, namely, near-ear speaker signals and front speaker signals, from an audio signal which includes plural audio channel signals, and outputs the generated signals to the filter processing unit 70.

In this variation, the sound pressure value adjustment unit 3*b* is included in the filter processing unit 70.

Specifically, the sound pressure value adjustment unit 3*b* according to this variation is achieved as software as with the near-ear speaker filter 4 and the front speaker filter 5, rather than an electronic circuit.

Specifically, gains of filter coefficients themselves corresponding to audio channel signals which the near-ear speaker filter 4 and the front speaker filter 5 have are adjusted in accordance with the gains stored in the sound pressure value adjustment unit 3*b*. More specifically, the sound pressure value adjustment unit 3*b* may perform computation of, for instance, multiplying by the value of a corresponding gain, only on an element corresponding to a sound pressure value of each audio channel signal among elements included in a matrix which represents filter coefficients that the near-ear speaker filter 4 and the front speaker filter 5 have.

As illustrated in FIGS. 17 and 18, even when the sound pressure value adjustment unit 3*b* is provided upstream relative to the filter processing unit 70, and when the sound pressure value adjustment unit 3*b* is achieved as part of the configuration of the filter processing unit 70, the same or similar effects are achieved.

As described above, according to the audio signal reproduction device 100B according to the present embodiment, the output sound pressure levels of the front speakers 51*s* and the near-ear speakers 52*s* are each appropriately controlled according to a desired sound field, thereby controlling the localization accuracy of the virtual sound sources generated by the speakers. As a result, an odd feeling can be reduced when the listener hears sound, such as separation and imbalance of sound fields, and furthermore the localization accuracy in a desired direction can be emphasized, thereby generating a sound field in which, for example, the rear localization by using a virtual sound source is emphasized. As a result, sounds can be localized with higher accuracy.

It should be noted that Embodiments 1 and 2 above may be combined. For example, the virtual sound field generation unit may generate first reproduction signals and second reproduction signals so that at least phases or sound pressure values of a first sound and a second sound are different at a listening position, the first sound being indicated by the first reproduction signals, and localized at a first position among first virtual sound positions, the second sound being indicated by the second reproduction signals, localized at substantially the same position as the first position, and substantially the same as the first sound. Controlling phases rather than sound pressure values can achieve localization of a sound position with higher accuracy, but requires higher cost. Therefore, a more appropriate configuration may be determined for the audio signal reproduction device, taking into consideration accuracy of sound localization and cost therefor.

It should be noted that the functional blocks illustrated in the block diagrams (FIGS. 1, 9, 10, 17, and 18) are achieved as LSIs which are typical integrated circuits. These may be individually formed into a single chip, or formed into a single chip so as to include some or all of the blocks.

For example, the functional blocks other than a memory may be formed into a single chip.

Although a large-scale integrated circuit (LSI) is mentioned here, the integrated circuit may also be called an integrated circuit (IC), a system LSI, a super LSI, or an ultra LSI, depending on the difference in the degree of integration.

Moreover, ways to achieve integration are not limited to the LSI, and a dedicated circuit or a general purpose processor can also achieve the integration. A field programmable gate array (FPGA) that can be programmed or a reconfigurable processor that allows reconfiguration of the connections and settings of the circuit cells inside the LSI may also be used.

In addition, depending on the emergence of circuit integration technology that replaces LSIs due to the progress of semiconductor technology or other derivative technology, such technology may of course be used to integrate the functional blocks. Application of biotechnology is one such possibility.

Furthermore, from among the functional blocks, a separate configuration may be adopted for a unit which stores data to be coded or decoded, rather than the unit is configured as a single chip.

The above is a description of embodiments with reference to the drawings; however, the present disclosure is not limited to the illustrated embodiments. It is possible to add various modifications and changes to the illustrated embodiments within the scope of the claims or within the equivalent scope.

Figure 19:
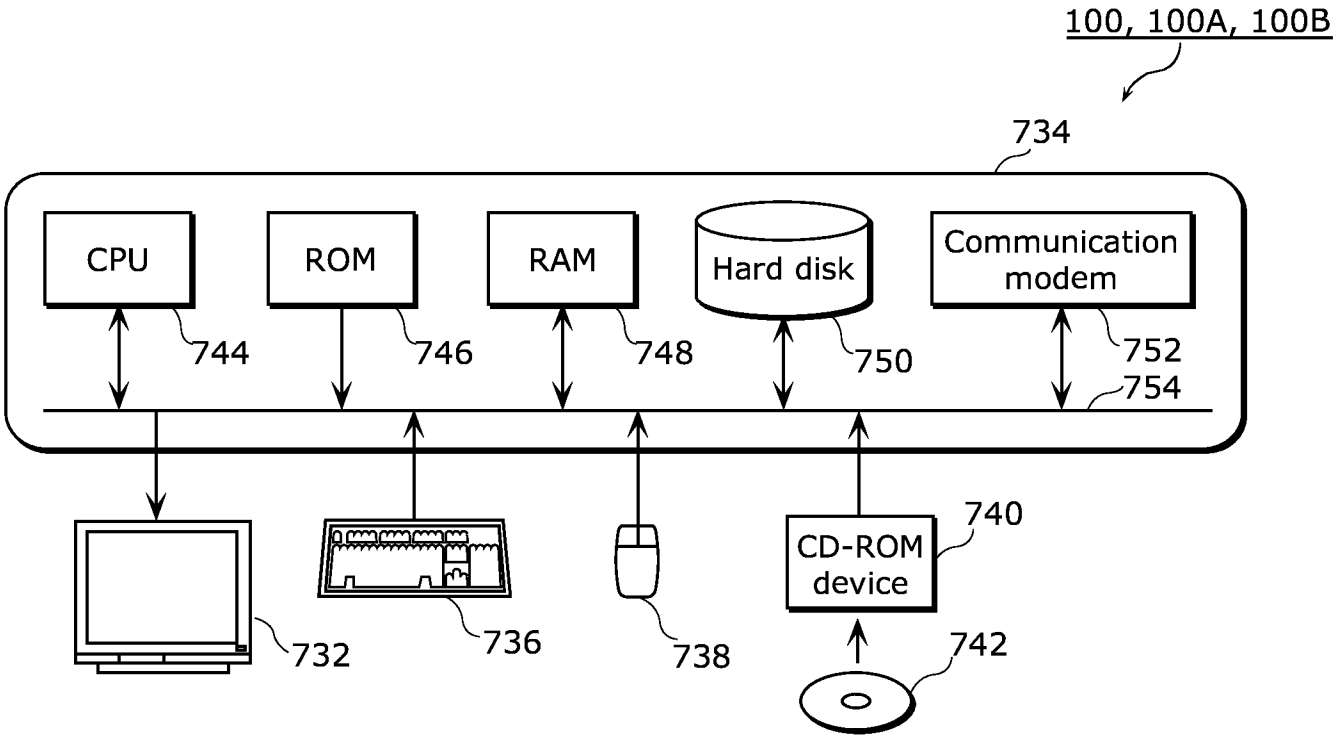
FIG. 19 is a block diagram illustrating a hardware configuration of a computer system which achieves the audio signal reproduction device according to Embodiments 1 and 2 and the variations thereof.

It should be noted that the audio signal reproduction device described in the embodiments can also be achieved by a computer. FIG. 19 is a block diagram illustrating a hardware configuration of a computer system which achieves the audio signal reproduction device.

The audio signal reproduction device includes: a computer 734; a keyboard 736 and a mouse 738 for giving instructions to the computer 734; a display 732 for presenting information such as the result of an operation of the computer 734; a compact disc-read only memory (CD-ROM) device 740 for reading a program that is executed by the computer 734; and a communication modem 752.

A program which indicates processing performed by the audio signal reproduction device is stored in a CD-ROM 742 which is a computer-readable medium, and is read by the CD-ROM device 740. Alternatively, the program is read by the communication modem 752 via a computer network.

The computer 734 includes a central processing unit (CPU) 744, a read only memory (ROM) 746, a random access memory (RAM) 748, a hard disk 750, the communication modem 752, and a bus 754.

The CPU 744 executes a program read via the CD-ROM device 740 or the communication modem 752. The ROM 746 stores a program and data necessary for operation of the computer 734. The RAM 748 stores data such as a parameter for program execution. The hard disk 750 stores a program, data, and others. The communication modem 752 communicates with other computers via a computer network. The bus 754 interconnects the CPU 744, the ROM 746, the RAM 748, the hard disk 750, the communication modem 752, the display 732, the keyboard 736, the mouse 738, and the CD-ROM device 740.

Furthermore, some or all of constituent elements included in the above devices may include an IC card or a single module which can be attached to or detached from the device. The IC card or the module is a computer system which includes a microprocessor, a ROM, a RAM, and the like. The above super-multifunctional LSI may be included in the IC card or the module. The IC card or the module accomplishes its functions through the operation of the microprocessor in accordance with the computer program. This IC card or module may have tamper resistant properties.

Further, the present disclosure may be a method described above. Further, the present disclosure may be a computer program which achieves the method using a computer, and may be a digital signal which includes the computer program.

Furthermore, the present disclosure may be the above computer program or the above digital signal stored in a computer-readable recording medium such as, for example, a flexible disk, a hard disk, CD-ROM, MO, DVD, DVD-ROM, DVD-RAM, Blu-ray Disc (registered trademark) (BD), a USB memory, a memory card such as an SD card, or a semiconductor memory. Furthermore, the present disclosure may be the above digital signal stored in such a recording medium.

Furthermore, the present disclosure may be a computer system which includes a microprocessor and memory, the memory has stored therein the above computer program, and the microprocessor may operate in accordance with the above computer program.

Furthermore, the above program or the above digital signal may be executed by another independent computer system by being recorded on the above recording medium and transferred to the system, or by being transferred to the system via the above network or the like.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The present disclosure is applicable to an apparatus which includes a device for driving two pairs or more of speakers and can reproduce music signals, and in particular is applicable to a surround system, TV, an AV amplifier, a stereo component system, a mobile phone, a portable audio apparatus, and others.

The invention claimed is:

1. An audio signal processing device comprising:

an input configured to receive an audio signal;

at least a first speaker and a second speaker, which are located on a first imaginary line; and at least a third speaker and a fourth speaker, which are located on a second imaginary line, the second imaginary line being closer to a position of a listener than the first imaginary line, wherein the first speaker and the second speaker are capable of outputting a first sound from the audio signal, the first sound generates a first virtual sound position, and the first virtual sound position is closer to the first imaginary line than the second imaginary line, wherein the third speaker and the fourth speaker are capable of outputting a second sound from the audio signal, the second sound generates a second virtual sound position, and the second virtual sound position is closer to the first imaginary line than the second imaginary line, and wherein a first sound pressure value of the first sound at the position of the listener is larger than a second sound pressure value of the second sound at the position of the listener, and/or the first sound reaches the position of the listener earlier than the second sound.

2. The audio signal processing device according to claim 1, wherein the first virtual sound position is located at a substantially same position as the second virtual sound position.

3. The audio signal processing device according to claim 1, wherein the first imaginary line is straight.

4. The audio signal processing device according to claim 1, wherein the second imaginary line is straight.

5. The audio signal processing device according to claim 1, wherein the third speaker and the fourth speaker face each other.

6. The audio signal processing device according to claim 5, wherein the position of the listener is located between the third speaker and the fourth speaker.

7. The audio signal processing device according to claim 1, wherein the audio signal received by the input comprises a 5-channel audio signal.

8. The audio signal processing device according to claim 1, wherein the first virtual sound position comprises at least two virtual sound positions and the second virtual sound position comprises at least two virtual sound positions.

9. The audio signal processing device according to claim 1, wherein the first virtual sound position comprises at least three virtual sound positions and the second virtual sound position comprises at least three virtual sound positions.

10. The audio signal processing device according to claim 1, further comprising a virtual sound field generation unit, wherein the virtual sound field generation unit reproduces a first sound signal for the first sound and a second sound signal for the second sound.

11. An audio signal processing device comprising:

an input configured to receive an audio signal;

at least a first speaker and a second speaker, which are located on a first imaginary line; and at least a third speaker and a fourth speaker, which are located on a second imaginary line, the second imaginary line being closer to a position of a listener than the first imaginary line, wherein the first speaker and the second speaker are capable of outputting a first sound from the audio signal, the first sound generates a first virtual sound position, and the first virtual sound position is closer to the second imaginary line than the first imaginary line, wherein the third speaker and the fourth speaker are capable of outputting a second sound from the audio signal, the second sound generates a second virtual sound position, and the second virtual sound position is closer to the second imaginary line than the first imaginary line, and wherein a second sound pressure value of the second sound at the position of the listener is larger than a first sound pressure value of the first sound at the position of the listener, and/or the second sound reaches the position of the listener earlier than the first sound.

12. The audio signal processing device according to claim 11, wherein the first virtual sound position is located at a substantially same position as the second virtual sound position.

13. The audio signal processing device according to claim 11, wherein the first imaginary line is straight.

14. The audio signal processing device according to claim 11, wherein the second imaginary line is straight.

15. The audio signal processing device according to claim 11, wherein the third speaker and the fourth speaker face each other.

16. The audio signal processing device according to claim 15, wherein the position of the listener is located between the third speaker and the fourth speaker.

17. The audio signal processing device according to claim 11, wherein the audio signal received by the input comprises a 5-channel audio signal.

18. The audio signal processing device according to claim 11, wherein the first virtual sound position comprises at least two virtual sound positions and the second virtual sound position comprises at least two virtual sound positions.

19. The audio signal processing device according to claim 11, further comprising a virtual sound field generation unit, wherein the virtual sound field generation unit reproduces a first sound signal for the first sound and a second sound signal for the second sound.

* * * * *